US011274908B2

(12) United States Patent
Vabnick

(10) Patent No.: US 11,274,908 B2
(45) Date of Patent: Mar. 15, 2022

(54) PENETRATOR PROJECTILE FOR EXPLOSIVE DEVICE NEUTRALIZATION

(71) Applicant: Federal Bureau of Investigation, Washington, DC (US)

(72) Inventor: Ian B. Vabnick, Quantico, VA (US)

(73) Assignee: The United States of America as Represented by the Federal Bureau of Investigation, Department of Justice, Washington, DC (US)

( * ) Notice: Subject to any disclaimer, the term of this patent is extended or adjusted under 35 U.S.C. 154(b) by 322 days.

(21) Appl. No.: 16/209,643

(22) Filed: Dec. 4, 2018

(65) Prior Publication Data

US 2020/0173761 A1 Jun. 4, 2020

(51) Int. Cl.
*F42B 12/08* (2006.01)
*F42D 5/04* (2006.01)

(52) U.S. Cl.
CPC ..... *F42B 12/08* (2013.01); *F42D 5/04* (2013.01)

(58) Field of Classification Search
CPC .... F24B 12/08; F24B 12/00–06; F24B 12/04; F24B 12/02; F24B 12/06; F42D 5/04
USPC ..... 102/521
See application file for complete search history.

(56) References Cited

U.S. PATENT DOCUMENTS 2,491,516 A 12/1949 Piggot et al.
3,545,383 A * 12/1970 Lucy ..... F42B 10/08 102/517
3,880,083 A * 4/1975 Wasserman ..... F42B 10/08 102/519
3,910,194 A * 10/1975 Dehm ..... F42B 14/02 102/527
4,046,055 A 9/1977 McDonalds et al.
4,108,073 A * 8/1978 Davis ..... F42B 12/06 102/518
4,635,556 A * 1/1987 Boecker ..... F42B 12/06 102/518
4,643,099 A * 2/1987 Luther ..... F42B 12/06 102/517
4,716,834 A * 1/1988 Wallow ..... F42B 12/06 102/519
4,788,915 A * 12/1988 Sauvestre ..... F42B 10/08 102/439
4,815,682 A * 3/1989 Feldmann ..... F42B 10/06 102/521

(Continued)

FOREIGN PATENT DOCUMENTS

ES 2083894 A2 4/1996
GB 2083894 A 3/1982

OTHER PUBLICATIONS

U.S. Appl. No. 15/731,874, filed Aug. 18, 2017.
U.S. Appl. No. 16/366,487, filed Mar. 27, 2019.

*Primary Examiner* — Joshua E Freeman
(74) *Attorney, Agent, or Firm* — Leydig, Voit & Mayer, Ltd.

(57) ABSTRACT

Provided herein are penetrator projectiles for use with explosive ordnance disposal disrupters, and related methods of making and using. The penetrator projectile has a tip, neck, shaft and base, wherein the geometry and composition of the different elements are selected to ensure the projectile is ballistically stable after firing to provide improved free-flight characteristics and corresponding explosive ordnance disruption.

25 Claims, 12 Drawing Sheets

(56) References Cited

U.S. PATENT DOCUMENTS

| | | | | |
|---|---|---|---|---|
| 4,836,108 | A * | 6/1989 | Kegel | F42B 12/06 102/306 |
| 4,961,384 | A * | 10/1990 | Sayles | F42B 12/06 102/519 |
| 5,058,503 | A * | 10/1991 | Adams, III | F42B 30/08 102/501 |
| 6,186,072 | B1 * | 2/2001 | Hickerson, Jr. | F42B 12/06 102/517 |
| 6,305,293 | B1 * | 10/2001 | Fry | F42B 12/78 102/516 |
| 6,439,127 | B1 | 8/2002 | Cherry | |
| 6,644,166 | B2 | 11/2003 | Alexander et al. | |
| 6,745,696 | B1 * | 6/2004 | Rotkopf | F42B 12/625 102/376 |
| 7,096,791 | B2 * | 8/2006 | Vanmoor | F42B 5/025 102/501 |
| 8,276,495 | B1 | 10/2012 | Chiu et al. | |
| 9,322,625 | B1 | 4/2016 | Langner | |
| 9,329,009 | B1 * | 5/2016 | Moore | F42B 30/02 |
| 9,404,718 | B1 | 8/2016 | Shaver et al. | |
| 9,541,362 | B2 * | 1/2017 | Kraft | F42B 12/02 |
| 9,976,838 | B1 | 5/2018 | Langner | |
| 10,054,388 | B1 | 8/2018 | Langner | |
| 10,066,916 | B1 | 9/2018 | Vabnick et al. | |
| 10,495,433 | B1 * | 12/2019 | Langner | F42D 5/04 |
| 2004/0055502 | A1 * | 3/2004 | Hunn | F42B 10/02 102/519 |
| 2011/0061521 | A1 | 3/2011 | Gardner et al. | |
| 2011/0214582 | A1 * | 9/2011 | Glasser | F42B 14/08 102/439 |
| 2016/0370159 | A1 * | 12/2016 | Bootes | F42B 12/204 |
| 2019/0249944 | A1 | 8/2019 | Vabnick et al. | |

* cited by examiner

PENETRATOR PROJECTILE FOR EXPLOSIVE DEVICE NEUTRALIZATION

STATEMENT OF GOVERNMENT INTEREST

The invention described herein was invented by an employee of the United States Government and thus, may be manufactured and used by or for the U.S. Government for governmental purposes without the payment of royalties.

BACKGROUND OF INVENTION

In the art of hazardous devices access and disablement, including explosive ordnance disposal, a common tool, particularly for neutralizing improvised explosive devices (IEDs), is a disrupter or dearmer, also referred herein as a propellant driven disrupter. As described in U.S. patent application Ser. No. 15/731,874, filed Aug. 18, 2017 and titled "Highly Efficient Energy Transfer Fluids," the disrupters may fire a liquid projectile. Certain disrupter adaptations can be utilized to further increase the capabilities of the liquid projectile, including U.S. patent application Ser. No. 15/896,760 filed Feb. 14, 2018 and titled "Reverse Velocity Jet Tamper Disrupter Enhancer". Although such liquid projectiles can be very effective in reliably and controllably destroying explosive devices, there are limitations, including for hard targets with shells or layers that are not amenable to reliable penetration by a liquid projectile and corresponding IED disruption. Liquid jets generally cause volumetric disruption and do not precisely destroy fuzing components.

For example, some known IED threats and newly emerging IED threats use steel-cased devices containing thermal and/or impact sensitive propellants or thermal or impact sensitive high explosives. Currently used render safe procedures (RSPs) carried out with gun-type EOD disrupters use high velocity steel or other metal or metal composite projectiles to vent hard cased IEDs. An unwanted consequence of this approach is the tremendous pressures and shock waves that are produced. For example, steel projectiles that hit steel targets have matched shock impedances and thus efficiently propagate shock waves. Such shock waves can compress the explosives that fill the IED.

The explosives' compression occurs quickly and adiabatic conditions are created. The explosives can heat up to ignition temperatures. In addition, indirect impact of explosives by hot casing fragments or projectile fragments can cause ignition.

Conventional penetrator technology may pierce relatively thin-walled steel containers, for example, a steel drum or a steel ammo box, and potentially cause initiation of the explosives therein. A need exists for disrupter projectiles that can penetrate a range of steel case thicknesses of an explosive device without detonating the explosives in the device. That need is addressed herein by utilizing lower velocities and special tip geometry to greatly reduce the risk of shock initiation.

In view of certain limitations of solid projectiles for firing on target from a disrupter, specially configured penetrators are proposed. See, e.g., U.S. Pat. No. 10,066,916 titled Low Impact Threat Rupture Device for Explosive Ordnance Disrupter, providing a projectile with a beveled cutting edge. There remains a need, however, for projectiles having improved flight characteristics, target penetration, and corresponding disruption of explosive device componentry with relatively high precision that are encased in a hard shell.

SUMMARY OF THE INVENTION

Provided herein are Short Pulse Intense Kinetic Energy (SPIKE) penetrators for use with a propellant-driven disrupter, and related methods of making and using. The penetrators are specially configured and provide a number of functional benefits, including a high degree of accuracy, minimal fragmentation and spallation, and low shock impulse production upon target interaction. These benefits are important for applications related to explosive device disruption. The benefits are achieved by specially selecting and configuring the various constituent parts of the projectile to ensure ballistic stability by positioning the center of pressure (CP) at a different location than the center of gravity (CG). In particular, the CP is proximally positioned relative to the more distally-positioned CG. The separation distance between the CP and CG may be at least 0.5", such as between 0.5" and 2", and any subranges thereof. This provides a fundamentally-improved stable free-flight characteristic, including stable free-flight for distances up to 10 feet or even greater.

Provided herein is a penetrator projectile for use in a disrupter. The term "disrupter" is used interchangeably with the term "explosive ordnance disposal (EOD) disrupter". The projectile may comprise: a tip having a tip distal end and a tip proximal end; a neck having a neck distal end and a neck proximal end, wherein the neck distal end is connected to the tip proximal end; a shaft having a shaft distal end and a shaft proximal end, wherein the shaft distal end is connected to the neck proximal end; and a base having a base distal end and a base proximal end, wherein the base distal end is connected to the shaft proximal end. The term "connected" is used broadly herein, and includes an integral connection, where the different components are formed of a unitary material, but is intended to provide clarity as to the different components having a different functional purpose or geometry. Connected also includes different components that, at some point, may have been made separately, but are subsequently combined to form the penetrator, such as by a weld, adhesive, press-fit, rotatable connection (e.g., threaded screwing), or any other means known in the art. Each of the neck, shaft and base, at least for those portions intended to fit within the disrupter barrel, have a maximum diameter that is equal to or less than a bore inner diameter of the propellant driven disrupter. The tip distal end has a pointed tip shape configured to penetrate a hard target without substantial deformation of the tip and a tip angle that is less than or equal to 30°, such as between 7° and 18°. "Hard target" refers to an outer casing formed of a hard material such as metal, wood or plastic and also refers to the material thickness. The neck has a circular cross-section to fit within the barrel. The base can be cylindrically-shaped with the base proximal end configured to face a breech region of the disrupter and the tip distal end faces away from the breech region and is directed on target. The tip, neck, shaft and base are together configured to provide a center of gravity (CG) and center of pressure (CP) that are separated from each other with the CG in a distal position relative to the CP.

The penetrator projectile may be further described in terms of the tip and tip geometry. For example, the tip shape can be radially symmetric about a longitudinal axis. The tip shape may be biphasic. "Biphasic" is used herein to refer to a tip shape having a profile with a step or change in angle or curvature. The tip profile may have two or more curvatures between the distal and proximal ends. The transition zone(s) between two or more different tip profile regions can beneficially result in a higher stress on impact with components, thereby resulting in a more rapid fracture of the component. This provides a functional benefit of increasing the reliability of disarming the target.

The penetrator projectile may have a maximum diameter of the tip ($D_{tip}$) that is less than a maximum diameter of the neck ($D_{neck}$), wherein $0.001\ D_{bore}<(D_{tip}-D_{neck})/D_{neck}<0.05\ D_{bore}$, wherein $D_{bore}$ is the bore diameter of the propellant driven disrupter.

The penetrator projectile may have a tip with a plurality of longitudinally-extending angled regions. The longitudinally-extending angled regions facilitates penetration of a hard target and subsequent controlled disruption of an explosive device.

The tip may have a proximal region that is ogive, conical, catenary, parabolic, convex, concave, or hemispherical with a wider angle than the tip angle. The tip may have a distal region with a cross-sectional shape that is square, hexagonal, or circular.

The tip, having a tip angle, has a maximum diameter region that is up to 150% of the bore inner diameter. The minimum diameter is at the most distal portion that is a tip, with a tip diameter that is less than or equal to 0.2", 0.1", 0.07", or 0.04", or the tip may reduce to a single sharp point.

The penetrator projectile may be further described in terms of the neck and neck geometry. For example, the neck may have an outer surface that is cylindrical. The neck may be formed of a different material than the other parts, such as the tip, shaft and base. The neck may be solid. The neck may be hollow or may contain a void volume.

The penetrator projectile may be further described in terms of the shaft and shaft geometry. The shaft is particularly useful for configuring to specifically adjust CP and/or CG to achieve desired flight and penetration characteristics. For example, the shaft may comprise an inner hollow volume positioned toward a distal end of the shaft and configured to receive weighted shot, wherein the weighted shot has an average diameter between 30 μm and 700 μm, and the weighted shot optionally comprises of lead or tungsten.

The shaft may be comprised of a plurality of longitudinally-extending ribs radially distributed around a symmetrical solid core.

The penetrator projectile may further comprise retractable fins positioned in the shaft when the penetrator projectile is in a disrupter barrel and deploy when the penetrator projectile is fired out of the disrupter barrel. Upon target entry, the fins may again retract as they pass through the hard target surface, and subsequently again deploy as the radially-inward directed force is removed upon passage through the hard target surface casing.

The penetrator projectile may have a shaft that is a right angle hollow cylinder with a wall thickness, wherein the wall thickness is optionally up to eleven times smaller (e.g., up to about $0.08*S_{OD}$), than a shaft outer diameter ($S_{OD}$).

The penetrator projectile may have a shaft geometry that is a tapered angle hollow cylinder with a wall thickness, wherein the tapered angle provides a maximum shaft diameter toward a distal shaft end and a minimum shaft diameter toward a proximal shaft end. The taper angle optionally starts at a starting shaft position, including a shaft position that is optionally 50% or more of the shaft length from the neck proximal end. The maximum taper region diameter is equal to or up to 20% less than a bore inner diameter, and a minimum taper region diameter at the proximal end of the shank that is up to 50% less than a bore inner diameter.

The shaft may comprise a material that is the same as the material that forms the tip and neck. Alternatively, the penetrator projectile shaft may comprise a material that is different than a material that forms the tip and neck. In this manner, the projectile can be described as a "composite", as different components are formed of different materials For example, tool steel or tungsten carbide can be used for the tip and neck regions and the shaft can be constructed of aluminum, carbon fiber reinforced polymer, carbon polymer core lined with aluminum/steel or other high strength composite material. In this manner, the relative positions of the CG and CP are controlled, so as to achieve desired flight and penetrating characteristics, including based on the specific application. Using a shaft with a low density inner core of a high strength material such as carbon fiber reinforced polymer greatly increases the stiffness of the shaft. It can withstand stresses that would normally cause it to buckle or fracture on impact.

The shaft may be connected to the neck via a threaded coupling, a press fit, a weld, or a silver solder, or for a carbon or plastic material, a Heli-coil® thread coupling.

The base may have a diameter that is greater than or equal to 50% of the bore inner diameter.

The penetrator projectile may be further described in terms of one or more characteristics affected by the geometry and structural composition of the underlying elements of the projectile, including position of the CP and CG. For example, the shaft longitudinally-extending ribs are configured to move a center of pressure of the penetrator projectile toward the base during firing and move the center of gravity toward the tip during firing. This beneficially increases the CP and CG separation distance, thereby, depending on the particular application conditions, provides a desired flight characteristic and target penetration and disruption characteristic.

The base, shaft, neck and tip geometry may be configured to provide, when fired, the CP positioned toward the base and behind a CG by a distance that is greater than 6% of the projectile length to provide a stable free-flight after firing.

Any of the penetrator projectiles provided herein may have a CG positioned 10%-30% closer to the tip distal end compared to the CP position.

Also provided herein are disrupters in combination with the penetrator projectile. Any of the penetrator projectiles may be provided in combination with a disrupter for improvised explosive device disruption or ordnance disruption. For example, the disrupter may comprise any of the described penetrator projectiles, a disrupter barrel, and wherein at least a portion of the penetrator projectile is configured to be positioned within the barrel before firing. The SPIKE extends from the chamber through the forcing cone into the bore. This improves accuracy and in general conventional projectiles do not extend through the forcing cone of an EOD disrupter.

The disrupter may have at least a portion of the penetrator projectile positioned in a portion of the disrupter barrel bore, and a liquid column positioned adjacent or around the base proximal end and extends toward a breech region configured to receive a blank cartridge to thereby form a hydraulic seal prior to firing the penetrator projectile.

The penetrator projectile may be entirely seated or partially seated in the disrupter barrel bore, with the base proximal end in contact with an explosive cartridge in the disrupter chamber, or with a liquid disposed there between.

The disrupter may further comprise a blank cartridge in a chamber region of the disrupter barrel and a shot cup, wadding or plug seated between the blank cartridge and the penetrator projectile base, wherein the base of the penetrator projectile maybe seated against a shot cup, wadding or plug. The shot cup, wadding or plug may be seated between the blank cartridge and the projectile base. It can have intimate contact with both the blank cartridge and the projectile base. The plug can be made of a semi-solid (ex. Clay), rubber, foam rubber, plastic, metal or plastic foam, or aluminum.

Also provided herein are methods of disrupting a target, including by: providing a penetrator projectile, inserting at least a portion of the penetrator projectile into a bore of a disrupter barrel, optionally where the bore contains a liquid in a sufficient volume so that upon projectile insertion, a portion of the liquid is forced out the barrel; and firing the penetrator projectile from the disrupter barrel toward the target.

The penetrator projectile may be reusable.

The penetrator projectile may, after the firing step, be in stable free-flight as characterized by no observable yaw or tumbling for a stand-off distance that is up to 50 feet.

Also provided herein is a method of making a ballistically stable penetrator projectile for use in an EOD disrupter, including by: configuring the tip, neck, shaft and base elements to provide a CP that is "behind" or located proximally relative to the CG. The CP-CG separation distance may be at least 0.5", or between about 0.5" and 2", depending on the length of the penetrator projectile. As described herein, the method may be achieved by shaping the components and/or composition (e.g., effective density) of the components relative to each other.

Without wishing to be bound by any particular theory, there may be discussion herein of beliefs or understandings of underlying principles relating to the devices and methods disclosed herein. It is recognized that regardless of the ultimate correctness of any mechanistic explanation or hypothesis, an embodiment of the invention can nonetheless be operative and useful.

BRIEF DESCRIPTION OF THE DRAWINGS

FIG. 9A is a side view, FIG. 9B is a view toward the tip end, with section A-A cutaway illustrated in FIG. 9C. FIG. 9D is a gray-scale surface shading of the penetrator projectile of FIGS. 9A-9C.

FIG. 12A is a perspective view. FIG. 12B is a cross-sectional view illustrating the positioning of the reinforced element, in this example in a tube form that lines the hollow shaft region. FIG. 12C is an exploded view with the reinforced element removed from the shaft region.

DETAILED DESCRIPTION OF THE INVENTION

Figure 1:
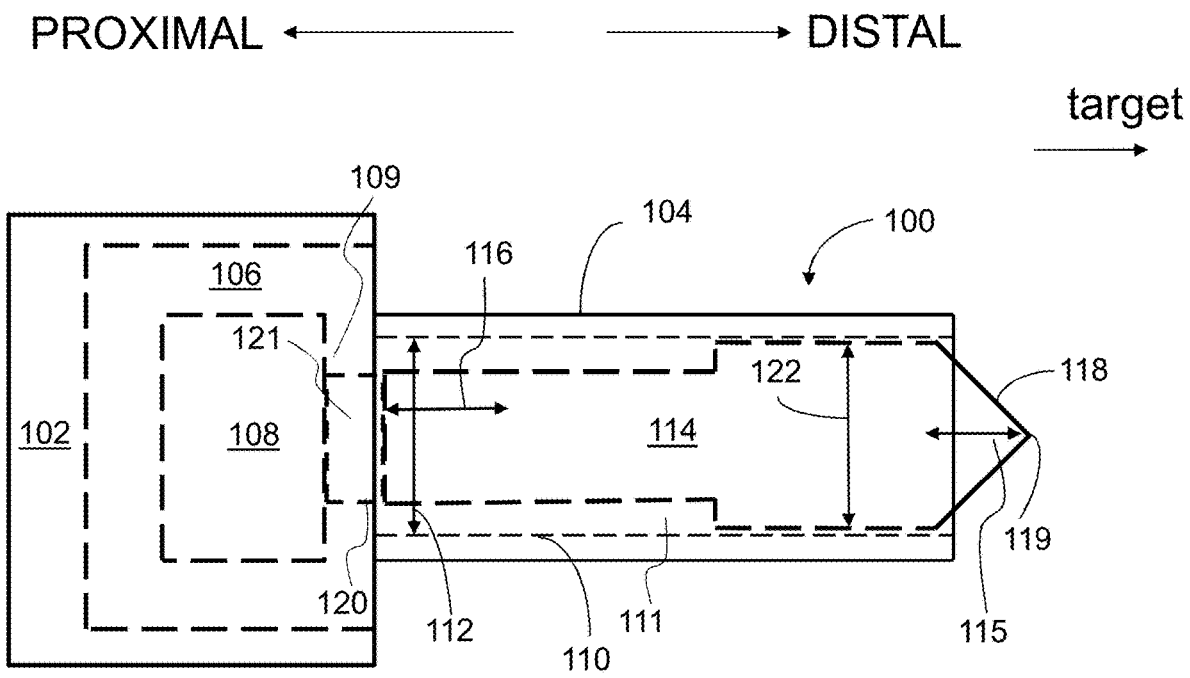
FIG. 1 is schematic of an exemplary disrupter, also referred herein as an explosive ordnance disposal (EOD) disrupter, and an exemplary penetrator projectile positioned at least partly therein.

In general the terms and phrases used herein have their art-recognized meaning, which can be found by reference to standard texts, journal references and contexts known to those skilled in the art. Referring to the drawings, like numerals indicate like elements and the same number appearing in more than one drawing refers to the same element. The following definitions are provided to clarify their specific use in the context of the invention.

The term "chamber" refers to the portion of the barrel of the EOD disrupter in which an explosive cartridge is positioned.

The term "breech" refers to the enclosure at the rear of the disrupter that contains the action. In some cases, the chamber can be part of the breech. In some cases the terms chamber and breech are used interchangeably.

The term "forcing cone" refers to the region of the bore that is a tapered transitional zone that reduces the diameter from the chamber diameter to the smaller bore diameter. One reason why the instant penetrators are so accurate is that they can extend through the forcing cone into the bore. Chamber d=0.83" tapers in the forcing cone down to the bore d=0.73". Conventional projectiles (d=0.7") have a smaller diameter than the chamber and so they bounce against the walls of the forcing cone until they enter the bore. Accordingly, any of the penetrators described herein may be described, as when fully seated, extending into the bore.

"Distal" refers to a direction that is furthest from the breech or the explosive cartridge, or that is closest to the to-be-disrupted target. "Proximal" refers to a direction that is toward the explosive cartridge or that is furthest from the to-be-disrupted target. Accordingly, the term proximal region or distal region refers to a region of a component that is more toward the disrupter or that is more toward the target. Similarly, for proximal end or distal end. For example, the terms region and/or end may describe a portion of the element that is in at least the half toward the target (distal) or toward the explosive cartridge/breech (proximal).

"Operably connected," "operatively coupled," "operatively connected," and "operatively coupled" refers to a configuration of elements, wherein an action or reaction of one element affects another element, but in a manner that preserves each element's functionality. The connection may be by a direct physical contact between elements. The connection may be indirect, with another element that indirectly connects the operably connected elements.

The term "substantially equivalent" refers to one or more properties of two or more elements that are within 10%, within 5%, within 1%, or are equivalent. For example, the diameter of an element A is substantially equivalent to the diameter of an element B if these diameters are within 10%, within 5%, within 1%, or are equivalent.

Any of the penetrators described herein may be characterized as being ballistically stable. "Ballistically stable" refers to having good free-flight characteristics, such as no yaw or tumbling, including at within a six foot or a ten foot standoff. No other smooth bore penetrator is designed to be ballistically stable at six feet, and are often captured in high speed video tumbling and having yaw.

"Retractable", in the context of retractable fins, refers to fins that upon application of a radially-directed inward force, are stored within the body of the projectile, including within the shaft region. Upon removal of the radially-directed inward force, the fins can deploy, such as during the free-flight between the barrel tip and the target surface. Upon penetration into the target, a radially-directed inward force generated by the target shell as the projectile penetrates the target, the fins may again be force into the shaft inner volume, and redeploy as the fins pass through the target surface.

In the following description, numerous specific details of the devices, device components and methods of the present invention are set forth in order to provide a thorough explanation of the precise nature of the invention. It will be apparent, however, to those of skill in the art that the invention can be practiced without these specific details.

The SPIKE penetrators described herein are versatile and can be used with any of a wide range of disrupters and corresponding flight characteristics. For example, the SPIKE velocity can be subsonic or supersonic. The SPIKE advantageously have a barrier limit thickness equal to or greater than currently available penetrator projectiles (such as better than 0.5" thick mild steel) and can travel significantly farther through continuous medium such as explosives without causing shock initiation of thermally and shock sensitive explosive materials.

Currently available penetrator projectile do not have the above characteristics. Available penetrators suffer poor performance with unacceptable post-barrier accuracy and undesirable significant fragmentation and spallation. A large radial spray of fragments may cause an IED to trigger either due to damaging sensitive fuzing components or shock initiation of the main charge. Conventional projectiles generally have supersonic velocities and profiles which result in a high probability of causing shock initiation of explosives, including as observed in explosive impact tests. Accordingly, there is a need for a projectile that fills the critical gap of precision component destruction within IEDs.

The SPIKE disrupter penetrator provided herein is typically eight times longer and can have a mass eight times that of currently available penetrators. The tip shape does not conform to current known ballistic profiles used in rifles or shotguns. No disrupter projectile has a similar tip profile as, described below. The tip shape is optimized for hard target, including steel barrier, penetration and does not cause barrier fragments. The SPIKE is so efficient at barrier perforation that when shot into thin (steel containers, anti-disturbance switches placed against the impacted surface had delayed response times in field tests. Using a high speed camera in tests where the SPIKE is fired through ⅛" mild steel barriers there was no measurable loss in velocity. The tip shape also reduces the shock pulse of the projectile and thus reduces the probability of shock initiation of explosives. There is no yaw observed within a six foot standoff and no yaw or tumbling during post-barrier flight. No other smooth bore penetrator is designed to be ballistically stable at six feet and are often captured in high speed video tumbling and having yaw. Yaw is when a projectile's longitudinal axis is not in line with its trajectory. The SPIKE shape and mass distribution used to produce ballistically stable flight adapts model rocketry and archery, and depends primarily on airflow around the projectile. No other disrupter projectile uses these stable flight principles. The materials used to construct the SPIKE are selected based on their tensile strength and hardness. There is no measurable deformation of the SPIKE after recovery. This also contributes to the SPIKE's post-penetration accuracy. Current disrupter projectiles are deformed during impact.

The SPIKE penetrator has several functional regions described as follows: the tip region is the front of the SPIKE and is symmetrical radially relative to the projectile's longitudinal axis. The tip may be biphasic, such as composed of two or more distinctly curved surfaces or profile regions and have complex profiles through the long axis central plane. The neck region is typically a right angle cylinder shape equal in diameter to the disrupter bore and connects the tip to the shaft. The neck length can be adjusted to manipulate the mass distribution in the SPIKE. The shaft or shank region is the middle section of the SPIKE. The shaft can be straight or tapered and have both internal and external structures. The back of the SPIKE is the base region which is flat or rounded. The latter geometry reduces impulsive pressures and reflective shock waves in the bore at the base location as demonstrated in computational modeling and bore pressure testing.

The shaft of the SPIKE may have voids or be hollow. Some of the voids may contain a defined quantity of weighted tungsten or lead shot. This shot can be microparticles as small as 30 μm in diameter and as large as number 6 shot. The particle flow can cause an increase in the duration of loading similar to a dead blow hammer and also affect the position of the center of gravity, thereby facilitating ballistic stability.

The SPIKE penetrator's flight is ballistically stable prior to hitting a barrier and remains stable post-penetration. High speed video captured in two orthogonal planes shows almost no yaw. The SPIKE can be fired through an unrifled bore. Stable free-flight is accomplished by positioning the center of pressure (CP) rearward behind the center of gravity (CG) by at least 0.5". The ratio of CP to CG positions measured from the base of the projectile is adjusted by mass distribution and by outer surface profile. The SPIKE does not require fins to create the air drag needed for stable flight. The CG is positioned 10-30% closer to the tip of the projectile relative to CP. The CG can be adjusted forward by hollowing portions of the shaft, narrowing the shaft diameter in various sections or using a lower density material in the shaft.

Another method of moving the CG forward of center is by adding fluting to the shaft or cutting radial pockets in the shaft.

Fins placed on the back half of the projectile will move the CP further to the rear of the projectile and increase the air pressure amplitude. The latter will enable the SPIKE to travel at greater free-flight distances without the tip of the projectile dipping downward causing the longitudinal axis of the projectile to be out of alignment with its trajectory. Increasing the surface area of the projectile rear shaft section increases the air pressure at the CP point. In one embodiment of the SPIKE, the two or more fins are retractable and the width measured from fin-tip to fin-tip is greater than the disrupter bore diameter by up to 1.5 times. The fins retract during projectile insertion into the disrupter and then expand out after exiting the barrel.

The fins can be offset by two degrees and have a twist or offset relative to the central plane along the longitudinal axis of the projectile. The offset will cause the projectile to spin stabilize as it flies through the air thus creating additional stability by imparting angular momentum to the projectile. The rise to run of the fin edge can range between 1:3 and 1:4 ratios. The fin angle relative to the shank surface can range between 10° and 20°. This will reduce the stress on the fins as they retract through the hole in the barrier created by the projectile. The fins can then expand open after the projectile passes through the barrier.

An alternative means to increase the air pressure at the CP point is by reducing the diameter of the shaft region and symmetrically distributing ribs along the longitudinal axis of the projectile that extend between the base and the tip region. The removal of material by fluting or cutting radial pockets in the shaft create the ribs also moves the center of gravity forward to meet the required CP to CG ratio. This design does not adversely impact shank stiffness, which is important during the impact event with the barrier. The ribs provide structural stiffness to reduce bending of the shaft.

The SPIKE can be spin stabilized through rifling of the disrupter bore. In this aspect, the widest section of the tip is slightly smaller in diameter than the shank. The reduction in diameter ranges from 0.1% to 5% of the bore diameter to prevent tip contact with the lands in the rifling. The shank can be constructed of aluminum or a thin copper or brass coating over a steel body. Using a soft material in or over the shank allows for the surface to be cut as it moves through the lands and grooves inside the bore and does not damage the rifling. Unlike current penetrators, the SPIKE does not need a sabot to be spin stabilized when fired from a disrupter.

The tip of the projectile can be constructed of steel and hardened to between 40-60 Hardness Rockwell C. This range is consistent with tool grade steel. The tip can have a point and can be ogive, pyramidal or conical. A six-sided and a 4-sided cross sectional geometry are efficient at barrier penetration and have less velocity loss post-penetration compared to other geometries. The tip apex angle can range from 10° to 20°. The tip can be 2 to 6 inches long such that the transition to the shank is smooth and the maximum diameter of the tip rear is equal to the shank diameter. The hexagonal cross sectional geometry is used in cold steel chisels and shows great rigidity and resistance to buckling failure under quasi-static conditions. A small ⅛" long section of the point may have a sharper angle of 30°-40° commonly seen in chisels.

The hexagonal cross sectional tip geometry is very efficient at barrier penetration and shows improved depth through continuous medium compared to currently available penetrator projectiles. This geometry can penetrate relatively thick or hard targets without a measurable loss in velocity, transit an air gap and then travel through 18 inches of alternating layers of conveyer belt rubber and thick polycarbonate plastic sheets retaining its original trajectory. The SPIKE can easily penetrate thick polycarbonate sheet whereas a current penetrator projectile constructed of mild steel traveling at twice the velocity does not pass through the same polycarbonate barrier. The SPIKE is also capable of penetrating thick A36 mild steel while retaining 80% of its velocity and hit a target smaller than a 9V DC alkaline battery. Current penetrator projectiles traveling at three times the SPIKE's velocity were shown to lose 50% of their velocity post-penetration of similar A36 mild steel plates.

The shaft can be a composite of materials. Composite examples are aluminum and carbon polymer, steel and carbon polymer, or titanium and carbon polymer, aluminum and titanium, or copper and steel. The shaft can be made of the same material as the tip, which is steel. The shaft can contain a ring of tungsten near the tip region. The shaft stiffness is important during impact with the barrier to avoid unwanted deformation. The shaft stiffness is dependent on the material strength and also can be increased by adjusting the geometry, such as by shortening the shaft. For example, a 0.72 inch diameter shaft constructed of aluminum may be less than or equal to 6 inches long. A longer aluminum shaft will buckle on impact with a ⅛" thick mild steel barrier. A typical SPIKE projectile for a 12 gauge disrupter is 7.25" to 8" in length from base to tip point. The projectile will experience a force on impact with a barrier and a pressure wave will propagate down the shaft and reflect at the base-air interface. The projectile will flex due to the stress. To reduce deflection of the projectile due to flexing, the shaft can be tapered and the base is slightly reduced in diameter compared to the widest diameter of the shaft.

The SPIKE can be between 2 inches to 26 inches in length measured from base-to-tip. Based on Hopkinson's bar theory, the duration of impact and thus time a projectile is pushing through a barrier is proportional to the projectile length. The SPIKE has a long duration of loading up to 26 times that of a standard disrupter slug. The high mass and long length of SPIKE are the primary parameters that give the projectile a high barrier limit thickness and extended post-barrier stable flight through a medium.

The SPIKE tip interacts with the barrier and pushes the material out radially. The material expands and is displaced forward and outward. The material fails and petals symmetrically. The SPIKE tip creates high pressures at the tip that exceeds the Hugoniot elastic limit of mild steel and aluminum barriers and the barrier fluidizes. The radial flow of the barrier material is evident by observing the edge region of the hole. The barrier reaction improves accuracy when the longitudinal axis of the projectile impacts at an angle relative to the normal vector of the surface. Tests showed that as much as a 20° angle of incidence against 1/16 inch thick mild steel barriers had no measurable loss in accuracy. The SPIKE process of perforation also reduces fragmentation of the barrier which is observed when projectiles punch and cause material to fracture to produce a hole. A hexagonal tip cross section of the projectile allows for concentrated pressure along the corners of each edge face causing the material to separate and the petals provide relief of compression as the hole expands.

The barrier also has elasticity and will expand and contract similar to an elastic membrane that is impacted. As a result, the hole diameter produced by the projectile will also expand and contract. A tapered shaft leading to a smaller diameter base will not interact with the edge of the hole.

Greater accuracy is empirically demonstrated for tapered shafts and smaller diameter bases. The hole after penetration is approximately equal to or less than the diameter of the widest region of the projectile. This is because after the projectile exits the barrier, the barrier oscillation dissipates and the material relaxes. Accordingly, any of the penetrators provided herein may have a taper shaft, may have a base end with a diameter less than a characteristic diameter toward a distal portion of the penetrator, or both.

The SPIKE projectile can weigh between 0.5 ounces and one pound. The large mass of the SPIKE projectiles relative to other penetrators that typically weigh one ounce or less contributes to the penetration through barriers and continuous medium such as explosives. The large inertia also reduces the SPIKE's susceptibility to deflection. The SPIKE can have up to twenty times the momentum of currently available penetrator projectiles for an equivalent cartridge strength. The mass of the SPIKE will affect the terminal velocity of the projectile after it exits the barrel for a given explosive cartridge strength. The cartridge strength and output energy is controlled by varying the propellant quantity and type.

The SPIKE velocity can be subsonic or supersonic. Using mass and length to increase penetration rather than velocity has several advantages. Subsonic projectiles do not produce shock waves in the impacted barrier and the IED's explosives. The impact pressures are lower and the pressure waves dissipate more quickly. This reduces the risk of shock initiation of IED explosive charges. The shock effects can be further minimized by using a pointed tip geometry. The shock impulse is smaller due the pressure wave's rapid attenuation. The pressure at the tip may be higher but the duration of the wave is considerably shorter in comparison to blunt or flat-nosed projectiles. This is confirmed empirically by shooting into steel-faced containers filled with propellants. No explosive reactions are observed. Other advantages of subsonic projectiles is reduced thermal effects caused by heating the projectile and barrier.

The diameter of the SPIKE shaft at its widest point, for at least the portion that is inserted into the disrupter bore, is equal to the diameter of the disrupter bore. The SPIKE can be made to fit standard bullets and cartridges such as the .357, .308, .410, .50, 16 gauge and 12 gauge or other rifle or shotgun bore diameters. A custom cartridge can be made such that the cartridge extends into the forcing cone and the tip of the SPIKE is seated in the bore. Any of the SPIKE's may be used with a shot cup between the SPIKE base and the blank explosive cartridge. This results in most of the SPIKE being seated in the bore and extending through the forcing cone region of the barrel. This will significantly stabilize the SPIKE as it motors down the barrel. A secondary benefit is reduced breech pressures. Currently available penetrator projectiles are enclosed in a shot shell that does not extend into the forcing cone. This causes slop in the fitment of the projectile as it passes through the disrupter's forcing cone causing projectile deformation and wobble. The projectile's longitudinal axis may be out of alignment when it enters the bore region of the barrel.

The widest end of the tip region of the SPIKE can exceed the diameter of inner bore face by up to 3 times. Accordingly, at least a portion of the SPIKE tip having a diameter greater than the barrel bore will be external to the barrel. As with the SPLITR (U.S. Pat. No. 10,066,916), the SPIKE shank (shaft) will partially fill the bore. The remainder of the bore may be filled with water. O-rings or gaskets can be positioned on the SPIKE shank (shaft) near the muzzle interface to seal the water in the barrel.

To rapidly destroy certain IED fuzing components, the tip may have regions with distinct angles relative to the projectile axis and different cross-sectional geometry. For example, the rearward region of the tip may be ogive, conical, caternary or hemispherical and have a wider apex angle than the front region of the tip. The front portion of the tips would have either a square, hexagonal or circular cross-sectional profile. The apex will have an angle range of 10 to 20 degrees as stated above. The apex angle in the rearward portion of the tip can be two times that of the tip front. The result is a shoulder/corner at the transition between the two regions. A targeted component rather than being wedged apart will fracture in two and thus reduce the time for component destruction. Another embodiment will have a radius cut in the transition zone between the two tip regions. This is a sharp transition that will trap and shear fuzing components such as battery cells.

In another embodiment of the SPIKE, the widest region of the tip is less than or equal to the bore diameter. The SPIKE can be partially or fully seated in the bore. This is one method to control the acceleration time that the SPIKE is motoring in the barrel. The terminal velocity of the SPIKE after it exits the barrel will vary with depth in the barrel (see e.g., U.S. Pat. No. 10,066,916). The most common embodiment of the SPIKE is with it fully seated in the bore. The base of the SPIKE is in contact with the explosive cartridge, or a component interspersed in between, such as wadding, shot-cup and/or liquid such as water. The terminal velocity of the SPIKE after it exits the barrel can also be controlled by varying the explosive cartridge propellant quantity and type.

Another unique element of the SPIKE is due to its hardness and shape, the SPIKE does not get damaged after perforating the barrier. A soft catch system can be used to stop the SPIKE and it is reusable. Other than the SPLITR, no other disrupter projectile can be reloaded and fired repeatedly. There is a cost savings and benefit to public safety bomb technicians who desire to train with the tool.

FIG. 1 illustrates an exemplary disrupter or an explosive ordnance disposal (EOD) disrupter, 100. EOD disrupter 100 includes a disrupter body 102 operably connected to a disrupter barrel 104. EOD disrupter 100 includes a disrupter breech 106 positioned inside the body 102 proximal the barrel 104. EOD disrupter 100 includes a propellant such as an explosive cartridge 108 positioned inside chamber/breech 106. Disrupter barrel 104 includes a disrupter barrel bore 110 having an inner bore diameter 112. A penetrator projectile 114 for firing from EOD disrupter 100 at a target is configured to be positioned in barrel 104 before firing, such as adjacent or near the explosive cartridge 108, or with shot cup, wadding, plug or the like illustrated as 109 between the projectile base proximal end 121 and cartridge 109. As desired, a liquid column may be positioned between the cartridge (or plug, shot cup, wadding or the like adjacent to the cartridge) and the projectile base proximal end 121. Penetrator projectile 114 includes a tip distal region 115 and a base proximal region 116. Tip distal region 115 of projectile 114 includes a tip 118 having a tip distal end 119, that may taper to a point. Base proximal region 116 of projectile 114 includes a base 120 having a base proximal end 121. In the example shown in FIG. 1, the tip distal region 115 including tip 118 provides a maximum penetrator projectile diameter 122 of projectile 114, corresponding to about the bore inner diameter 112.

As illustrated in FIG. 1, before firing, at least a portion of penetrator projectile 114 is positioned within barrel 104 before firing. In the illustrated example, before firing, a portion of tip distal region 115 including tip distal end 119 is positioned and extends outside disrupter barrel 104, and at least a portion of the base proximal region 116 is positioned in at least a portion of barrel 104. Alternatively, before firing, the penetrator projectile 114 is entirely seated in the bore 110 of the disrupter barrel 104, such that no portion of projectile 114 is positioned outside barrel 104. Also, in the illustrated example, before firing, base proximal end 121 of projectile 114 is in contact with explosive charge 108 in disrupter breech 106. Alternatively, before firing, base proximal end 121 of projectile 114 is spaced from explosive charge 108 in breech 106, including with a shot cup, wadding, plug or the like, such as illustrated by 109. In addition, as desired a liquid column 111 may be positioned between a proximal portion of the penetrator, including but not limited to the base proximal end, and the cartridge, or a plug, wadding, or shot cup adjacent to the cartridge.

Use of a liquid column, including water, is useful for a number of reasons. For example, the liquid acts as a hydraulic seal and provides confinement needed to generate the pressure to drive the projectile. Smokeless powders in blanks need confinement to burn properly. Modeling demonstrates that the projectile has about a two-fold energy when water fills the void space of the bore. Accordingly, any of the devices and methods described herein includes a liquid, such as water, that fills the void space corresponding to an otherwise air volume formed between the penetrator and the inner bore wall. This can be achieved, for example, by filling the bore with liquid, and then inserting the penetrator in the bore, which forces excess water out of the bore so that a substantial portion of the air volume is replace with liquid, such as water.

The shot cup, plug or wadding 109 serves a similar function of limiting a co-volume when using a ribbed penetrator. Similar problems would occur with hollow penetrators that don't have a base or a tapered configuration. This is reflected by inconsistent velocity and reduced speeds without a plug. Another issue is the reflected shock in the breech that is reduced with a shot cup. It acts as a cushion due to shock impedance.

Figure 2:
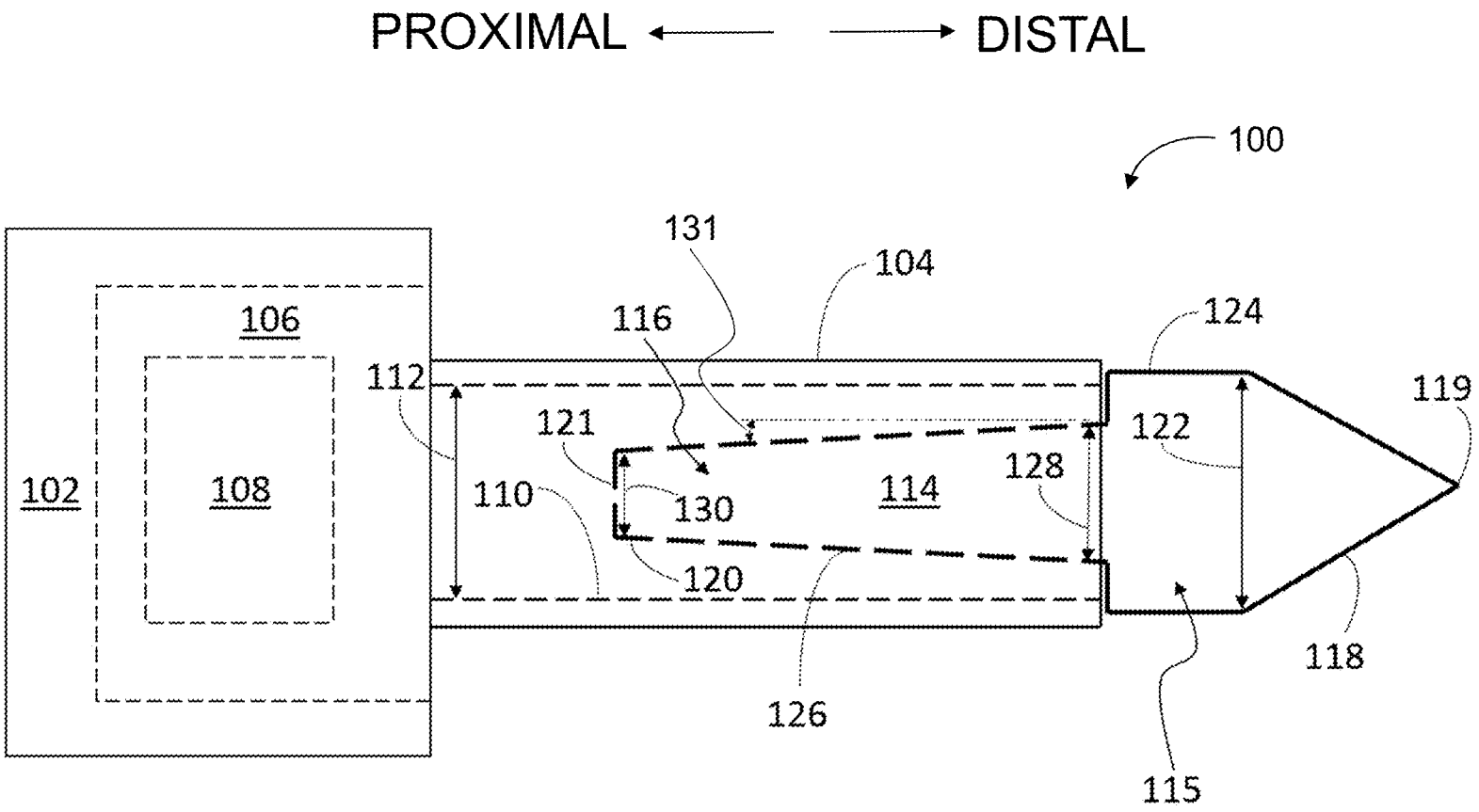
FIG. 2 is a schematic of the EOD disrupter shown in FIG. 1 and another exemplary penetrator projectile positioned therein.

FIG. 2 illustrates another exemplary penetrator projectile 114 pre-firing position configuration for the EOD disrupter 100 shown in FIG. 1. As in the example shown and described above with reference to FIG. 1, the tip 118 is positioned in a tip distal region 115. The penetrator projectile has a maximum penetrator projectile diameter 122. As illustrated in FIG. 2, before firing, at least a portion of tip distal region, including tip 118 has maximum penetrator projectile diameter 122 that is greater than bore diameter 112 of disrupter barrel 104. As such, at least tip distal region is positioned and extends outside barrel 104 and at least base proximal region 116 is positioned in at least a portion of barrel 104.

A neck 124 connects the tip to a shaft 126. Neck 124 is positioned and extends between tip 118 and a distal end of shaft 126. In the example shown in FIG. 2, a diameter of neck 124 is substantially equivalent to maximum penetrator projectile diameter 122. Also, in the illustrated example, before firing, base proximal end 121 of projectile 114 is spaced from explosive charge 108 in disrupter breech 106. Alternatively, before firing, base proximal end 121 of projectile 114 is in contact with explosive charge 108 in breech 106. Alternatively, before firing, a liquid column is positioned between base proximal end 121 of projectile 114 and explosive charge 108 in breech 106. A liquid column may also fill substantially all the air void defined by the space between an outer surface of the penetrator and the inner surface of the bore.

Also, as illustrated in FIG. 2, a first shaft diameter 128 of shaft 126 adjacent neck 124 is greater than a second shaft diameter 130 of shaft 126 adjacent base 120. As such, shaft 126 has a tapered shape, with a taper angle of 131. In the example shown in FIG. 2, taper angle 131 is about 5°. Alternatively, taper angle 131 is greater than 0° and less than 5°. In another alternative, taper angle 131 is greater than 5° and less than 10°. In yet another alternative, taper angle 131 is from 10° to 15°.

FIGS. 3, 4 and 5A-5D illustrate an exemplary penetrator projectile 114 for use in a disrupter 100 shown in FIGS. 1 and 2. Penetrator projectile 114 includes tip distal region 115 including tip 118 and tip distal end 119. Neck 124 has a neck distal region 132 and a neck proximal region 134. Neck distal region 132 is operably connected to tip proximal region 115. Neck 124 has a circular cross-section configured for a tight fit sealing with an inner surface of the disrupter bore. An outer surface 135 of neck 124 is cylindrical. Shaft 126 has a shaft distal region 136 and a shaft proximal region 138. Shaft distal region 136 is operably connected to neck proximal region 134. Base 120 has base proximal end 121 and a base distal region 139. Base distal region 139 is operably connected to shaft proximal region 138. Shaft 126 longitudinally extends between neck proximal region 134 and base distal region 139. Projectile 114 includes a plurality of longitudinally extending ribs 140 extending along at least a portion of shaft 126. In the example shown in FIGS. 3, 4 and 5A-5D, projectile 114 has a plurality of ribs 140 extend along a length of shaft 126. The example shown in FIGS. 3, 4 and 5A-5D is a reusable (e.g., re-fireable from EOD disrupter 100) penetrator projectile 114, which may be retrieved by a user after being fired from EOD disrupter 100. Inclusion of ribs 140 provides the ability to adjust the center of gravity relative to the center of pressure, thereby improving desired free-flight characteristics. The ribs provide strength and allow the removal of a considerable amount of material in this region.

Figure 3:
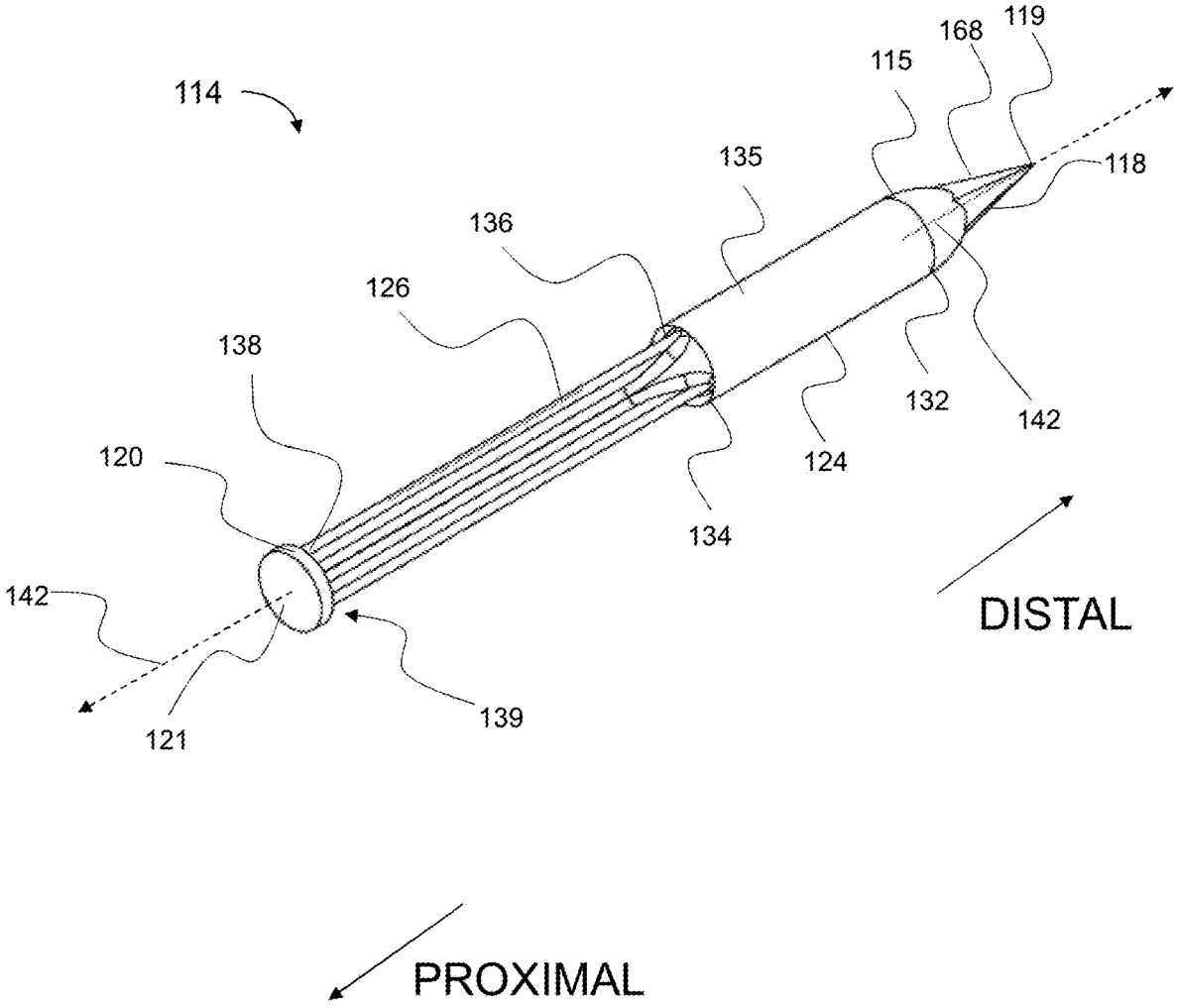
FIG. 3 is a perspective view of another exemplary penetrator projectile.
Figure 4:
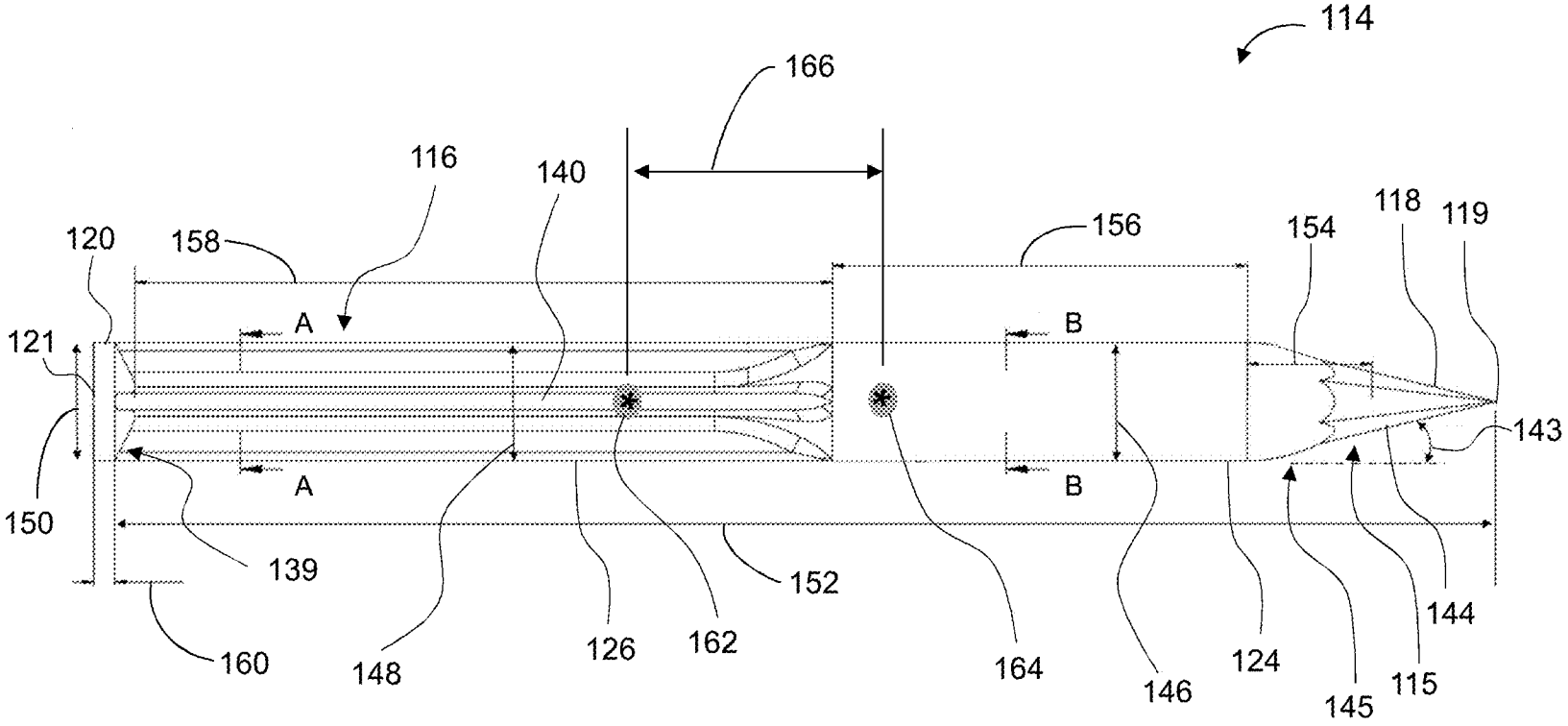
FIG. 4 is a side view of the penetrator projectile shown in FIG. 3.
Figure 5A:
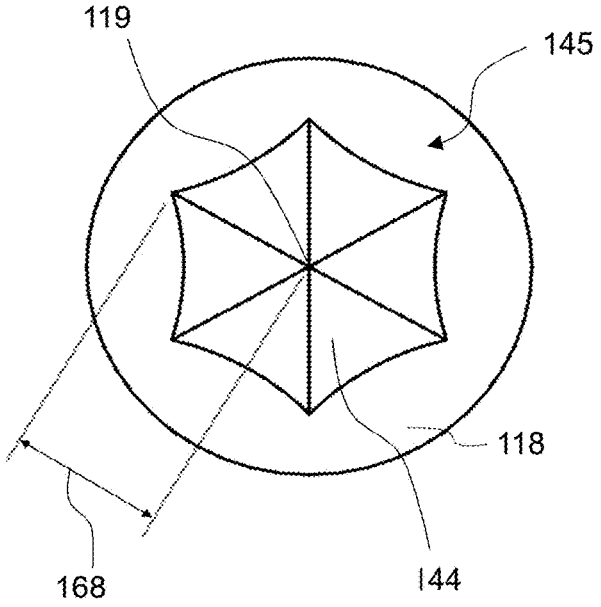
FIG. 5A is a frontal view from tip to base of the penetrator projectile shown in FIGS. 3-4.

In the example shown in FIGS. 3, 4 and 5A-5D, base 120 is cylindrically shaped. A longitudinal axis 142 (see dashed arrows in FIG. 3) of penetrator projectile 114 passes through a point defined by tip distal end 119 and a center point of circular base proximal end 121. Tip distal end 119 may have a pointed tip shape configured to facilitate reliable and controlled penetration of a hard target without substantial deformation, including an outer casing formed of a hard material such as metal, rubber, wood or plastic. Tip distal end 119 has a tip angle 143 that is less than or equal to 20°. Any of the penetrator projectiles 114 described herein may have tip proximal region 115 that is ogive, conical, catenary or hemispherical with a wider angle than the tip angle 143. Any of the penetrator projectiles 114 described herein may have tip distal region 115 with a cross-sectional shape that is square, hexagonal, or circular. As illustrated in FIGS. 3, 4 and 5A, tip 118 may have a plurality of longitudinally-extending angled regions 144.

In the example shown in FIGS. 3, 4 and 5A-5D, each of the neck 124, shaft 126, and base 120 have a maximum diameter (e.g., neck 146, shaft 148, and base 150 diameters, respectively) that is less than bore diameter 112 of the EOD disrupter 100 shown in FIGS. 1 and 2. Also, as illustrated in FIGS. 3, 4 and 5A-5D, neck 146, shaft 148, and base 150 diameters may all be substantially equivalent in value. Any of the penetrator projectiles 114 described herein may have a projectile length 152 that is less than 9 inches. Projectile length 152 is composed of a half tip length 154 (e.g., having a value of half a full length of tip 118), a neck length 156, a shaft length 158, and a base length 160. Full tip length (and thus also half tip length 154) of tip 118 may be greater than base length 160, and less than each of neck length 156 and shaft length 158. Shaft length 158 of shaft 126 may be greater than each of full tip length (and thus also half tip length 154), neck length 156, and base length 160. Neck length 156 of neck 124 may be less than shaft length 158, and less than each of full tip length is (and thus also half tip length 154) and base length 160.

As illustrated in FIG. 4, penetrator projectile 114 has a center of pressure (CP) 162 and a center of gravity 164 (CG). CP 160 and CG 162 are spaced apart by a CP-to-CG distance 166. In any of the projectiles 114 described herein, CP-to-CG distance 166 and the specific locations of CP 162 and CG 164 may vary according to the particular dimensions and materials of construction used for tip 118, neck 124, shaft 126, and base 120. CP 160 and CG 162 are spaced apart by a CP-to-CG distance 166. and selected to achieve both desired free-flight parameter and penetration on target parameter. The CP-to-CG distance also affects post-barrier accuracy.

In any of the penetrator projectiles 114 disclosed herein, shaft 126 may be constructed of a material and/or may have shaft 126 shape configured to move CP 162 projectile 114 toward base 120 during firing of projectile 114 from EOD disrupter 100. In any of the penetrator projectiles 114 disclosed herein, any combination of base 120, shaft 126, neck 124, and tip 118 geometry are configured to provide, when projectile 114 is fired from EOD disrupter 100 a suitable CP and CG relative positioning. In any of the penetrator projectiles 114 disclosed herein, CP 162 is positioned toward the base and behind CG 164 by CP-to-CG distance 166 that is greater than or equal to 0.5 inches to provide a stable free-flight after firing. In any of the penetrator projectiles 114 disclosed herein, CG 164 may be positioned 10%-30% closer to the tip distal end 119 compared to the position of CP 162. In any of the projectiles 114 disclosed herein, the ability to vary the material(s) of construction and/or the shape of shaft 126, and thus move CP 162 projectile 114 toward base 120 during firing of projectile 114 from EOD disrupter 100, and/or the ability to vary CP-to-CG distance 166, CP 162 position behind CG 164, and/or CG 166 positioning enables design and manufacture of projectiles 114 having varying flight characteristics and/or target penetration performance characteristics after firing from EOD disrupter 100 and to meet particular requirements and specifications for use in the field. Distinct practical, technical, and tactical advantages are thereby provided by the disclosed penetrator projectiles 114 as compared to known projectiles.

Referring again to FIGS. 1 and 2, in any of the penetrator projectiles 114 described herein, base 120 shown in FIGS. 3, 4, and 5A-5D is cylindrically-shaped with the base proximal end 121 configured to face disrupter breech 106 of EOD disrupter 100 when positioning in disrupter barrel 104 before firing. Tip distal end 119 faces away from breech 106 and is directed on target (e.g., by aiming EOD disrupter 100 at the target). In any of the projectiles 114 described herein, a maximum diameter of tip 118 (also referred to herein as $D_{tip}$) is less than a maximum neck diameter 146 of neck 124 (also referred to herein as $D_{neck}$. In any of the projectiles 114 described herein, $0.001\ D_{bore}<(D_{tip}-D_{neck})/D_{neck}<0.05\ D_{bore}$, where $D_{bore}$ is bore diameter 112 of disrupter barrel bore 110.

As shown in FIGS. 3 and 5A, tip 118 of penetrator projectile 114 includes tip knife edges 168 defining boundaries between adjacent angled regions 144. Inclusion of one or more tip knife edges 168 on tip 118 facilitates penetration of a target by the penetrator projectile 114 after firing from EOD disrupter 100 and provides another independent basis for positioning CG. In any of the projectiles 114 disclosed herein, varying a tip length 178 and the tip cross-sectional shape, the number and/or shape (including, without limitation, cross-sectional shape) of angled regions 144, the number of tip knife edges 169 and/or other tip knife edge 168 characteristics (including, without limitation, the strength, toughness, wear resistance, and/or edge holding characteristics of tip knife edge(s) 168) enables design and manufacture of projectiles 114 having varying flight characteristics and/or target penetration performance characteristics after firing from EOD disrupter 100. In any of the projectiles 114 disclosed herein, varying the aforementioned tip 118 characteristics facilitates design and manufacture of projectiles 114 having varying weights or masses, locations of CP 162 and/or CG 164, and CP-to-CG distances 166. In consequence thereof, any of the projectiles 114 disclosed herein may be designed and manufactured to have specified physical and/or performance characteristics for use with specified targets and/or target classes, explosive cartridge 108 charges, lengths and/or bore diameters 112 of EOD disrupter 100 barrel 104. Distinct practical, technical, and tactical advantages are thereby provided by the disclosed penetrator projectiles 114 as compared to known projectiles.

Figure 5B:
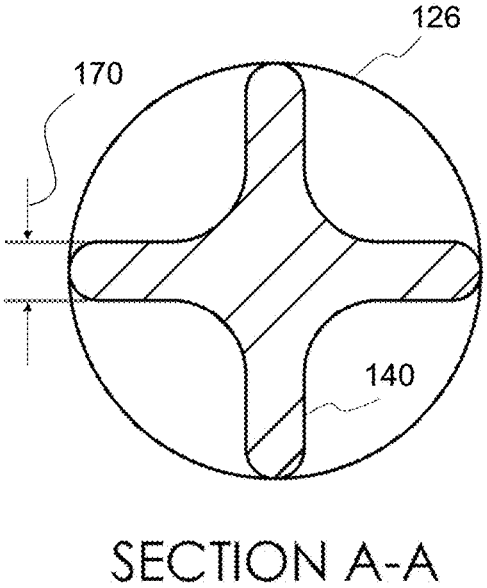
FIG. 5B is a cross-sectional illustration showing a cutaway through section A-A of the penetrator projectile shown in FIG. 4.
Figure 5C:
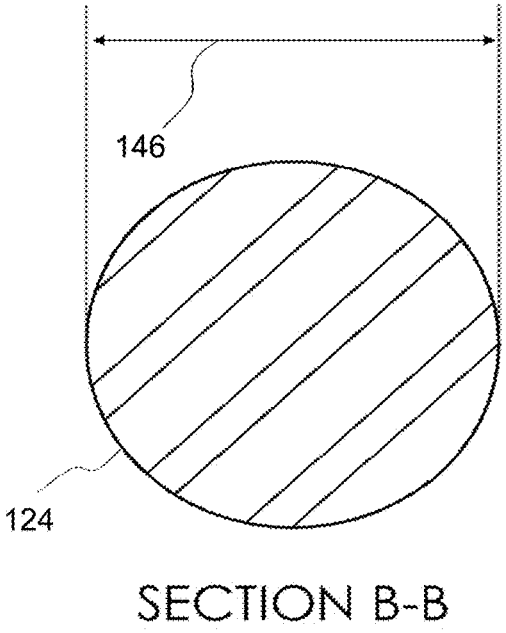
FIG. 5C is a cross-sectional illustration showing a cutaway through section B-B of the penetrator projectile shown in FIG. 4.
Figure 5D:
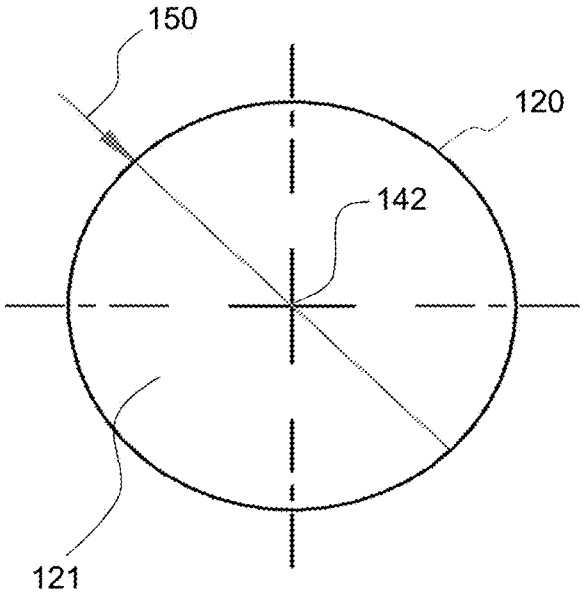
FIG. 5D is an illustration showing a frontal view from base to tip of the penetrator projectile shown in FIGS. 3, 4, and 5A-5C.

As shown in FIG. 5B, ribs 140 longitudinally extending along at least a portion of shaft 126 have a rib width 170. In the example projectile shown in FIG. 5B, shaft 126 includes four ribs 140 positioned in a radially symmetric fashion. Alternatively, shaft 126 may include one, two, or three ribs 140, or shaft 126 may include no ribs 140. In another alternative, shaft 126 may include greater than four ribs 140. In any of the penetrator projectiles 114 disclosed herein, varying the rib width 170, the number of ribs 140, and/or the lengths of ribs 140 present on shaft 126 enables design and manufacture of projectiles 114 having varying weights or masses, locations of CP 162 and/or CG 164, and CP-to-CG distances 166. In any of the projectiles 114 disclosed herein, and regardless of the number of ribs 140, varying the positioning of ribs 140 (e.g., radially symmetric fashion versus non-radially symmetric positioning of ribs 140) on shaft 126 enables design and manufacture of projectiles 114 having varying flight characteristics and/or target penetration performance characteristics after firing from EOD disrupter 100. Distinct practical, technical, and tactical advantages are thereby provided by the disclosed penetrator projectiles 114 as compared to known projectiles.

The entirety of penetrator projectile 114 may be formed of a unitary material of construction such as steel or a suitable variant thereof. Alternatively, the entirety of projectile 114 may be formed unitarily from aluminum or a suitable alloy thereof as the material of construction. In another alternative, the entirety of projectile 114 is formed unitarily from iron, tungsten carbide, titanium, copper, or any other suitable metal, or a suitable alloy thereof as the material of construction. In yet another alternative, the entirety of projectile 114 may be formed unitarily from a ceramic or suitable ceramic composite as the material of construction. In still another alternative, the entirety of projectile 114 may be formed unitarily from a carbon or suitable carbon-based composite material of construction. Another embodiment relates to the entirety of the projectile 114 formed unitarily of plastic, such as Delrin®, or Polylactic acid or other additive manufacturing plastic. In any of the penetrator projectiles 114 disclosed herein, varying the material of construction of projectile 114 enables design and manufacture of projectiles 114 having varying flight characteristics and/or target penetration performance characteristics after firing from EOD disrupter 100. Any of the projectiles 114 disclosed herein may thus be formed from a wide variety of materials of construction. Distinct practical, technical, and tactical advantages are thereby provided by the disclosed penetrator projectiles 114 as compared to known projectiles. As described herein below, the disrupter may be formed of different materials at different locations.

In any of the penetrator projectiles 114 disclosed herein, the entirety of penetrator projectile 114 is fabricated using an extrusion process. Alternatively, in any of the projectiles 114 disclosed herein, the entirety of projectile 114 is formed using a molding process. In another alternative, in any of the projectiles 114 disclosed herein, the entirety of projectile 114 is formed using a pressing process. In yet another alternative, in any of the projectiles 114 disclosed herein, the entirety of projectile 114 is formed using a machining process. In still another alternative, in any of the projectiles 114 disclosed herein, the entirety of projectile 114 is formed using an additive manufacturing. In still other alternative examples, in any of the projectiles 114 disclosed herein, the entirety of projectile 114 is formed using any other suitable fabrication process known to persons of ordinary skill in the art. In still other alternative examples, in any of the projectiles 114 disclosed herein, the entirety of projectile 114 is formed using any combination of the aforementioned fabrication processes. Any of the projectiles 114 disclosed herein may thus be manufactured using a wide variety of fabrication processes. Distinct practical, technical, and tactical advantages are thereby provided by the disclosed penetrator projectiles 114 as compared to known projectiles.

FIGS. 6 and 7A-7C illustrate another exemplary penetrator projectile 114 for use in EOD disrupter 100, including the one illustrated in FIGS. 1 and 2. In the example projectile 114 illustrated in FIGS. 6 and 7A-7C, shaft 126 is devoid of any ribs 140 extending along at least a portion of shaft 126. Rather, in the example, shaft 126 is cylindrically shaped and shaft diameter 148 is substantially equivalent to each of neck diameter 146 and base diameter 150.

Figure 7A:
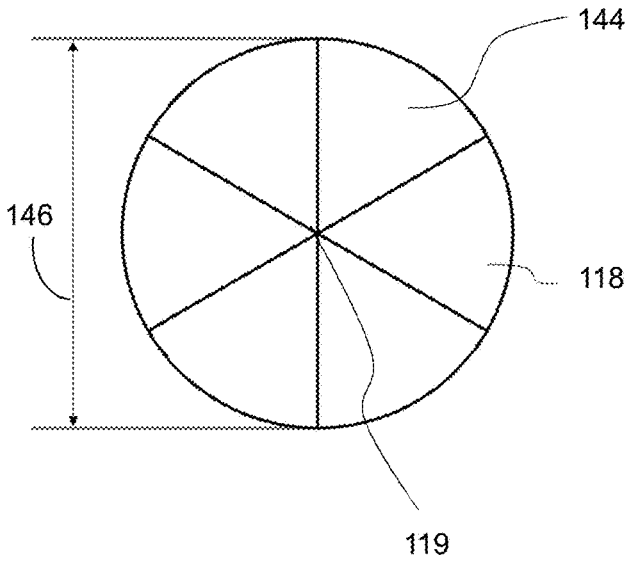
FIG. 7A is an illustration showing a frontal view from tip to base of the penetrator projectile shown in FIG. 6.
Figure 7B:
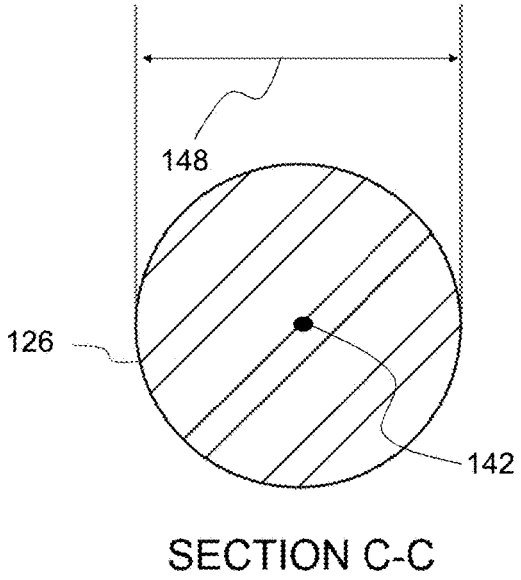
FIG. 7B is a cross-sectional illustration showing a cutaway through section C-C of the penetrator projectile shown in FIG. 6.
Figure 7C:
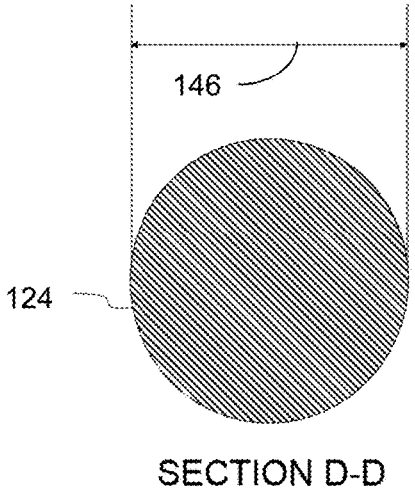
FIG. 7C is a cross-sectional illustration showing a cutaway through section D-D of the penetrator projectile shown in FIG. 6.

As shown in FIGS. 7B, and 7C, a material of construction of neck 124 and shaft 126 are different. In the illustrated example, tip 118 and neck 124 are formed of steel or a suitable variant thereof as the material of construction, and shaft 126 and base 120 are formed of aluminum or a suitable alloy thereof as the material of construction. Alternatively, shaft 126 is formed of aluminum or a suitable alloy thereof as the material of construction, and base 120 is formed of steel or a suitable variant thereof as the material of construction. In another alternative, tip 118 and neck 124 are formed of different materials of construction. In yet another alternative, any combination of tip 118, neck 124, shaft 126, and base 120 may be formed of iron, titanium, copper, or any other suitable metal, or suitable alloys thereof as the material of construction. In still another alternative, any combination of tip 118, neck 124, shaft 126, and base 120 may be formed of a ceramic or suitable ceramic composite as the material of construction. In still other examples, any combination of tip 118, neck 124, shaft 126, and base 120 may be formed of a carbon or suitable carbon-based composite material of construction. Thus, in any of the projectiles 114 disclosed herein where two or more of tip 118, neck 124, shaft 126, and base 120 are formed of dissimilar materials of construction, a wide variety of materials of construction may be used. Distinct practical, technical, and tactical advantages are thereby provided by the disclosed penetrator projectiles 114 as compared to known projectiles.

In examples where two or more of tip 118, neck 124, shaft 126, and base 120 are formed of different materials of construction, additive manufacturing or other suitable fabrication processes may be employed to achieve a unitarily formed projectile 144. Alternatively, adjacent parts (e.g., two or more of tip 118, neck 124, shaft 126, and base 120) of projectile 114 having different materials of construction may be operatively coupled together using any combination of welding, adhesive(s), and any other suitable joining technique known to persons of skill in the art of joining dissimilar materials. In another alternative, a threaded bolt may be formed or otherwise operatively coupled to a first part having a first material of construction along longitudinal axis 142 thereof. In this alternative example, a threaded bore may be formed along longitudinal axis 142 in a second part to be positioned adjacent to the first part, where the part is formed of a second material of construction different from the first material of construction. In this alternative, the two adjacent parts formed of dissimilar materials are operably coupled together by screwing the threaded bolt of the first part into the threaded bore of the second part. Thus, in any of the projectiles 114 disclosed herein where two or more of tip 118, neck 124, shaft 126, and base 120 are formed of dissimilar materials of construction, a wide variety of manufacturing processes and joining techniques may be employed. Distinct practical, technical, and tactical advantages are thereby provided by the disclosed penetrator projectiles 114 as compared to known projectiles.

In any of the penetrator projectiles 114 disclosed herein where two or more of tip 118, neck 124, shaft 126, and base 120 are formed of dissimilar materials of construction, varying the material of construction of any combination of tip 118, neck 124, shaft 126, and base 120 enables design and manufacture of projectiles 114 having varying weights or masses, locations of CP 162 and/or CG 164, and CP-to-CG distances 166. In any of the projectiles 114 disclosed herein where two or more of tip 118, neck 124, shaft 126, and base 120 are formed of dissimilar materials of construction, varying the material of construction of any combination of tip 118, neck 124, shaft 126, and base 120 enables design and manufacture of projectiles 114 having varying flight characteristics and/or target penetration performance characteristics after firing from EOD disrupter 100. In any of the projectiles 114 disclosed herein where two or more of tip 118, neck 124, shaft 126, and base 120 are formed of dissimilar materials of construction, any combination of tip 118, neck 124, shaft 126, and base 120 may thus be formed of a wide variety of materials of construction to enable achieving particular performance requirements and specifications related to tactical deployment, such as flight characteristics and/or target penetration performance characteristics after firing from EOD disrupter 100. Distinct practical, technical, and tactical advantages are thereby provided by the disclosed penetrator projectiles 114 as compared to known projectiles.

In any of the penetrator projectiles 114 disclosed herein where two or more of tip 118, neck 124, shaft 126, and base 120 are formed of dissimilar materials of construction, any combination of tip 118, neck 124, shaft 126, and base 120 is fabricated using an extrusion process. Alternatively, in any of the projectiles 114 disclosed herein where two or more of tip 118, neck 124, shaft 126, and base 120 are formed of dissimilar materials of construction, any combination of tip 118, neck 124, shaft 126, and base 120 is formed using a molding process. In another alternative, in any of the projectiles 114 disclosed herein where two or more of tip 118, neck 124, shaft 126, and base 120 are formed of dissimilar materials of construction, any combination of tip 118, neck 124, shaft 126, and base 120 is formed using a pressing process. In yet another alternative, in any of the projectiles 114 disclosed herein where two or more of tip 118, neck 124, shaft 126, and base 120 are formed of dissimilar materials of construction, any combination of tip 118, neck 124, shaft 126, and base 120 is formed using a machining process. In still another alternative, in any of the projectiles 114 disclosed herein where two or more of tip 118, neck 124, shaft 126, and base 120 are formed of dissimilar materials of construction, any combination of tip 118, neck 124, shaft 126, and base 120 is formed using an additive manufacturing. In still other alternative examples, in any of the projectiles 114 disclosed herein where two or more of tip 118, neck 124, shaft 126, and base 120 are formed of dissimilar materials of construction, any combination of tip 118, neck 124, shaft 126, and base 120 is formed using any other suitable fabrication process known to persons of ordinary skill in the art. In still other alternative examples, in any of the projectiles 114 disclosed herein where two or more of tip 118, neck 124, shaft 126, and base 120 are formed of dissimilar materials of construction, any combination of tip 118, neck 124, shaft 126, and base 120 is formed using any combination of the aforementioned fabrication processes. In any of the projectiles 114 disclosed herein where two or more of tip 118, neck 124, shaft 126, and base 120 are formed of dissimilar materials of construction, any combination of tip 118, neck 124, shaft 126, and base 120 may thus be manufactured using a wide variety of fabrication processes. Distinct practical, technical, and tactical advantages are thereby provided by the disclosed penetrator projectiles 114 as compared to known projectiles.

In the example illustrated in FIGS. 6 and 7A-7C, penetrator projectile 114 may include an inner hollow volume 172 formed as a hollow cavity in an interior of shaft 126. Inner hollow volume 172 is configured to receive weighted shot 174. Preferably, inner volume is positioned toward a distal region of the shaft (e.g., toward the neck and tip) to provide a preferred CG and CP location and separation distance. For example, within the most distal 50%, 30%, 20% or 10% of the shaft longitudinal length. Weighted shot 174 has a generally spherical or ovoid shape, but may be formed in any suitable shape to facilitate filling inner volume 172 with weighted shot 174. Weighted shot 174 may have an average diameter between 30 μm and 700 μm. Any of the penetrator projectiles 114 disclosed herein may include shaft 126 having an inner volume 172 filled at least partially with weighted shot 174, varying the positioning, shape, dimensions, and/or volume of inner volume 172 and/or the shapes, material(s) of construction, sizes, diameters, numbers, and/or percentage of inner volume 172 filled with shot 174 facilitates varying weight or mass distribution, including location of CP 162 and/or CG 164, and CP-to-CG distances 166. In any of the projectiles 114 disclosed herein including shaft 126 inner volume 172 filled at least partially with weighted shot 174, varying the aforementioned inner volume 172 and shot 174 physical characteristics enables design and manufacture of projectiles 114 having varying flight characteristics and/or target penetration performance characteristics after firing from disrupter 100, which, in some examples, may be varied "on the fly" in the field for particular targeting scenarios, such as introduction of different amounts, types, sizes of weighted shot. Distinct practical, technical, and tactical advantages are thereby provided by the disclosed penetrator projectiles 114 as compared to known projectiles.

Figure 6:
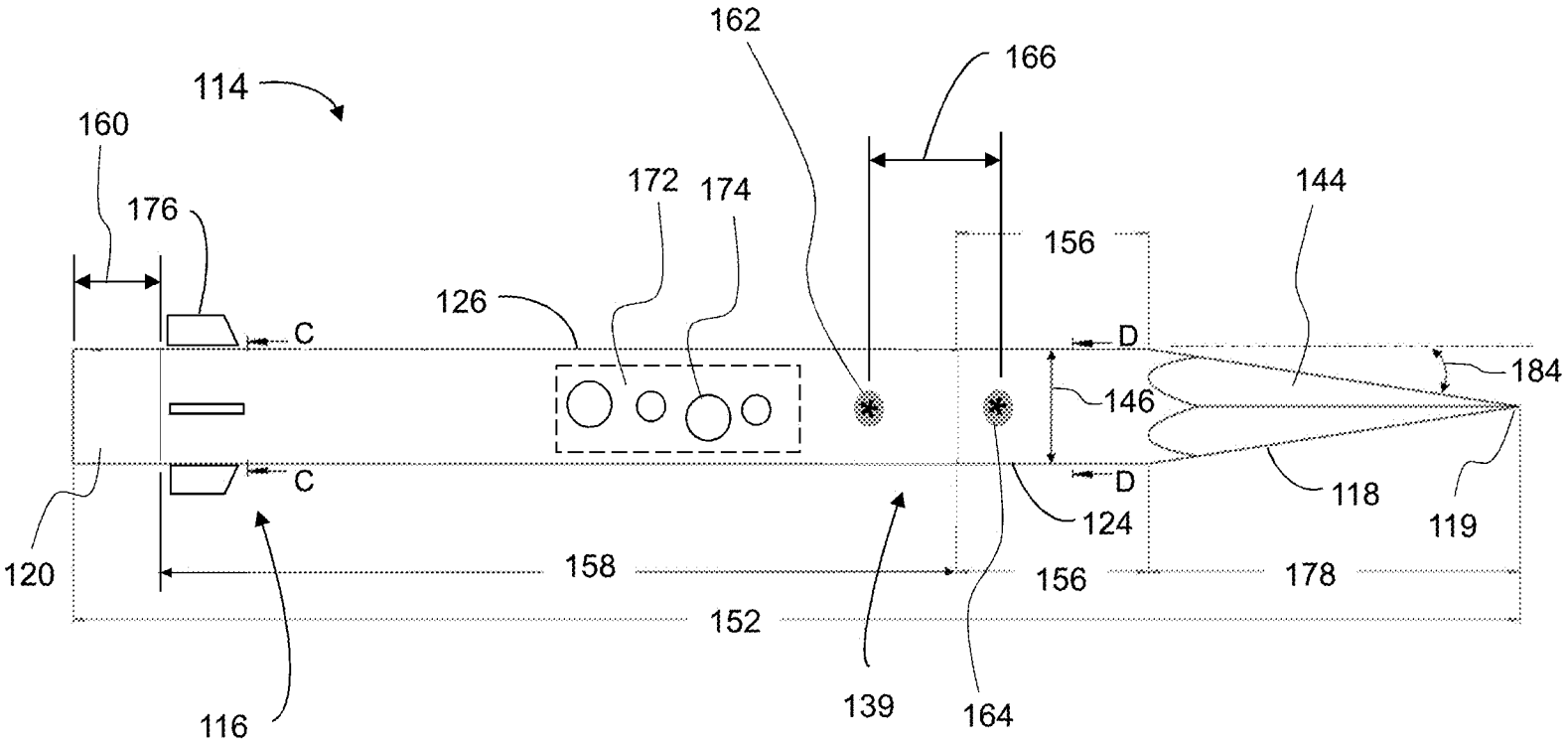
FIG. 6 is an illustration showing a side view of another exemplary penetrator projectile.

FIG. 6 illustrates that any of the penetrator projectiles 114 may include two or more fins 176 operatively coupled to shaft 126. Fins 176 may be positioned on and operatively coupled to shaft 126 at base proximal region 116 thereof. Alternatively, fins 176 are positioned on and operatively coupled to shaft 126 at base distal region 139 thereof. In another alternative, fins 176 are positioned on and operatively coupled to shaft 126 at a location that is substantially equivalent to a midpoint between base 120 and neck 124. In yet another alternative, fins 176 are positioned on and operatively coupled to neck 124. In still another alternative, fins 176 are positioned on and operatively coupled to base 120.

The fins may be retractable fins. Retractable fins 176 are positioned on and operatively coupled to shaft 126 (e.g., at least partially nested in suitably formed cavities in shaft 126). Retractable fins 176 deploy (e.g., reposition themselves from at least partially nested in shaft 126 cavities to a retracted position extending radially from shaft 126) when projectile 114 is fired out of disrupter barrel 104 of EOD disrupter. In the illustrated example, retractable fins 176 deploy upon the projectile 114 exiting disrupter barrel 104 of EOD disrupter 100. In other examples, retractable fins 176 deploy after a predetermined time delay after the projectile 114 exits barrel 104 or after EOD disrupter 100 is fired.

Alternatively, retractable fins 176 are positioned on and operatively coupled to neck 124 (e.g., at least partially nested in suitably formed cavities in neck 124) and deploy and reposition when projectile 114 is fired in a substantially equivalent manner as described above for retractable fins 176 positioned on and operably coupled to shaft 126. In another alternative, retractable fins 176 are positioned on and operatively coupled to base 120 (e.g., at least partially nested in suitably formed cavities in base 120) and deploy and reposition when projectile 114 is fired in a substantially equivalent manner as described above for retractable fins 176 positioned on and operably coupled to shaft 126 or neck 124. In yet another alternative, two or more sets of longitudinally-spaced retractable fins 176 are positioned on and operatively coupled to any combination of shaft 126, neck 124, and base 120 (e.g., at least partially nested in suitably formed cavities therein) and deploy and reposition when projectile 114 is fired in a substantially equivalent manner as described above for retractable fins 176 positioned and operably coupled to shaft 126, base 120, or neck 124.

Alternatively or additionally, projectile 114 includes two or more sets of fins 176, one or more sets may be retractable fins 176 and one or more sets may be non-retractable fins 176. In this alternative example, the two or more sets of fins 176—retractable or otherwise—may be substantially equivalently positioned in a radially symmetric fashion (e.g., each fin 176 substantially equivalent positions when projectile is viewed frontally, as in FIG. 7A). Alternatively, individual sets of the two or more sets of fins 176—retractable or otherwise—may each be positioned radially symmetrically, but with each set being spaced arcuately relative to other set(s) of fins 176 when projectile 114 is viewed frontally, as in FIG. 7A.

In the example projectile shown in FIG. 6, projectile 114 includes one set of four retractable fins 176 positioned on and operatively coupled to shaft 126 in a radially symmetric fashion. Alternatively, one set of one, two, or three retractable fins 176 may be positioned on and operatively coupled to projection 114, or projectile 114 may include no fins 176, retractable or otherwise. In another alternative, projectile 114 may include one set of greater than four retractable fins 176. In any of the penetrator projectiles 114 disclosed herein including fins 176, varying the shapes, widths, and/or lengths of fins 176, the number of fins 176 and/or the number of sets of fins 176, the positioning of fins 176 with a fin 176 set and/or between fin 176 sets, positioning of fins 176 radially symmetrically and/or non-radially-symmetrically, and/or, in the case of retractable fins 176, varying the fin 176 deployment timing enables design and manufacture of projectiles 114 having various free-flight characteristics, varying weights or masses, locations of CP 162 and/or CG 164, and CP-to-CG distances 166. In any of the projectiles 114 disclosed herein having fins 176, varying the aforementioned fin 176 physical and operational characteristics enables design and manufacture of projectiles 114 having varying flight characteristics and/or target penetration performance characteristics after firing from EOD disrupter 100. Distinct practical, technical, and tactical advantages are thereby provided by the disclosed penetrator projectiles 114 as compared to known projectiles.

Figure 8:
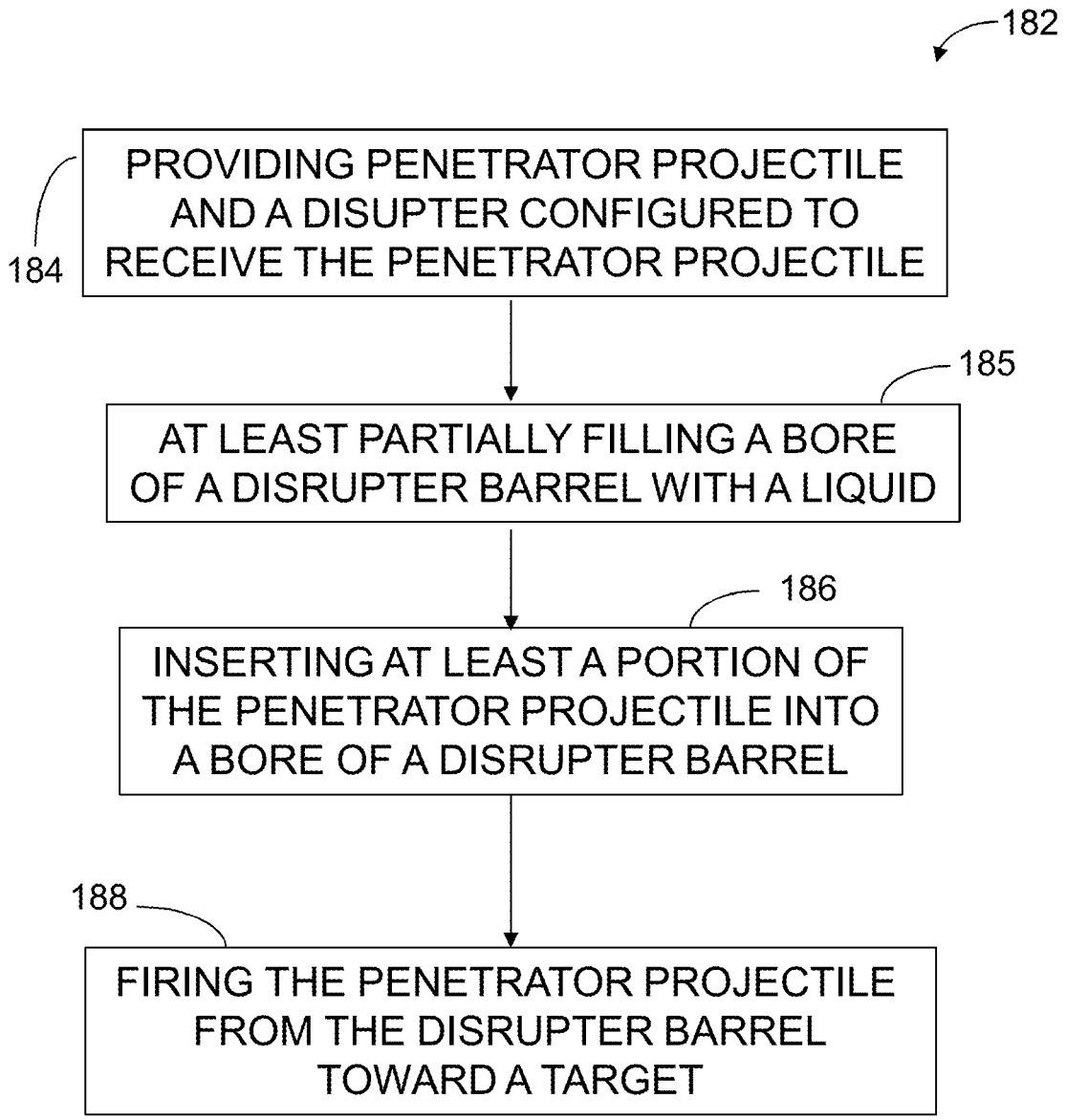
FIG. 8 is a flow chart summary illustration of an exemplary method 186 for firing a penetrator projectile from the EOD disrupter shown in FIGS. 1 and 2 at a target.
Figure 9A:
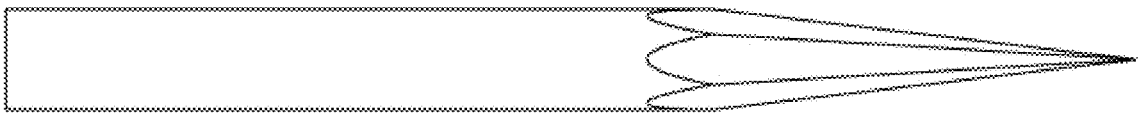
FIG. 9A-9D is an illustration of a penetrator projectile having a hollow cylinder geometry.
Figure 9B:
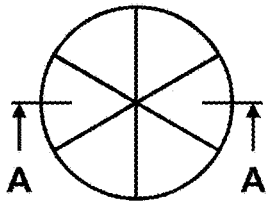
Figure 9C:
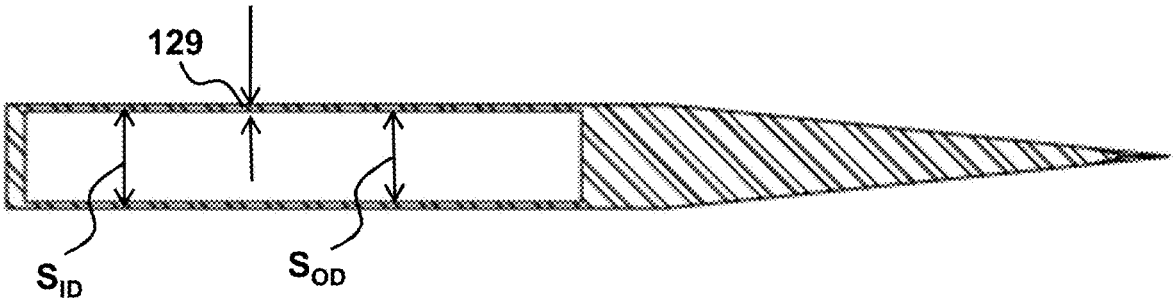
Figure 9D:
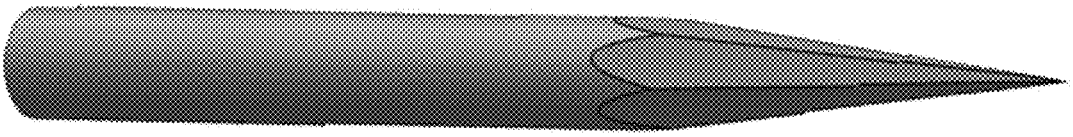

FIG. 8 is a flow chart summary illustration of an exemplary method 182 for disrupting a target. Method 182 includes providing 184 any of the penetrator projectiles 114 disclosed herein. Method 182 includes inserting 186 at least a portion of the penetrator projectile 114 into a bore of a disrupter barrel (e.g., bore 110 of barrel 104 of EOD disrupter 100 according to, for example, examples shown and described herein). As noted in step 185, the bore may be filled with a liquid, such as a column of water. When projectile is inserted in the bore, it may displace the water from the bore, thereby minimizing air pockets between the projectile and the inner walls of the barrel and the breech portion of the disrupter. In this manner, the fluid, such as water, can act as a hydraulic seal to provide confinement needed to generate the pressure to drive the projectile in a highly ballistically-stable manner. In use, the method 182 may include firing 188 penetrator projectile 114 from the disrupter barrel toward a target.

Any of the projectiles and methods may relate to a reusable penetrator projectile 114. Accordingly, the method may include retrieving the fired penetrator projectile 114 and reusing a fired penetrator projectile in step 184. In the example, the retrieving step of method 182 includes reusing the penetrator projectile 114, as in firing projectile 114 again one or more times from EOD disrupter 100 after a first firing event for projectile 114. Alternatively or additionally, in another example, in method 182, after the firing 188 step, the penetrator projectile 114 is in stable free-flight with desired free-flight characteristics, including in terms of yaw and roll and overall stability. In an example, the stable free-flight of projectile 114 after firing from, for instance, EOD disrupter 100, is characterized by no observable yaw or tumbling for stand-off distances that are up to 10 feet.

FIG. 9 illustrates a projectile having a hollow portion in the shaft region to provide desired ballistic stability, such as by controllably positioning the CG relative to the CM. The geometry has a relatively long and uniform tip angle, with a hexagonally-edged tip geometry, minimal neck region, and right-angled cylindrical shaft geometry. FIG. 9A is a side view, FIG. 9B a view toward the tip distal end, with section A-A cutaway view illustrated in FIG. 9C. FIG. 9D is a shaded to view to help visualize surface shape. Illustrated is a shaft that is a right angle hollow cylinder 127 with a wall thickness 129 defined by shaft outer diameter ($S_{OD}$) and shaft inner diameter (SID). To increase the flexural strength of this region, a light-weight high strength core can be added such as carbon fiber reinforced polymer rod or tube (FIG. 12A-12C).

Figure 10A:
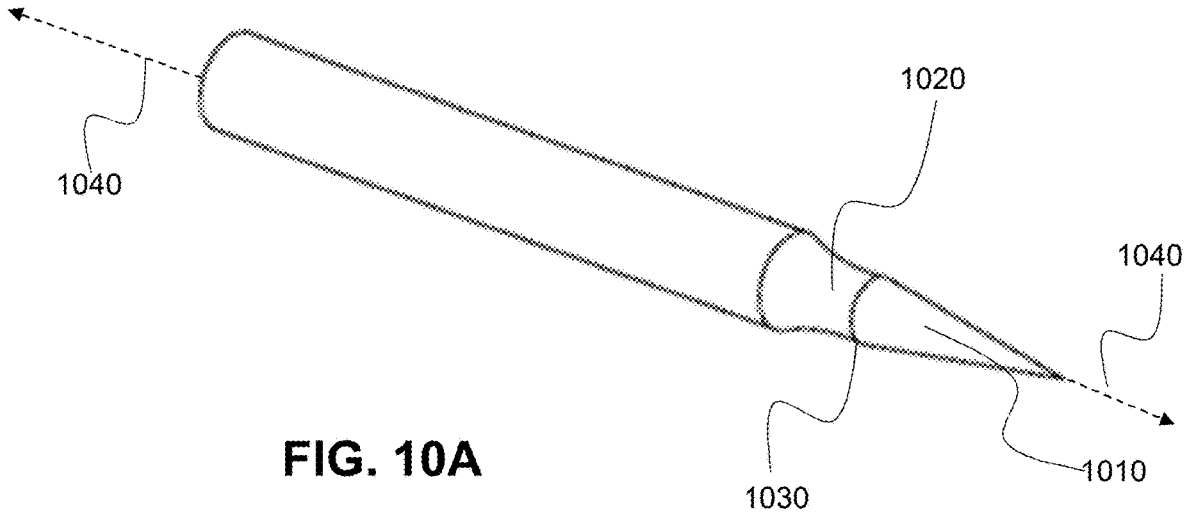
FIGS. 10A and 10B illustrate a biphasic concave tip with a cross-section illustrating a hollow shaft (FIG. 10B) and a perspective view to illustrate the outer surface shape (FIG. 10A).
Figure 10B:
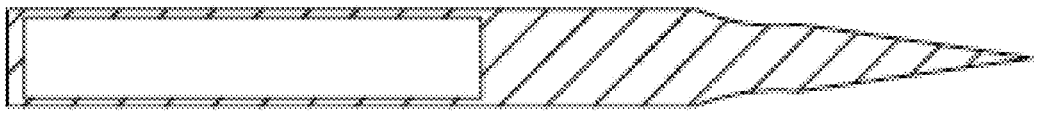
Figure 11A:
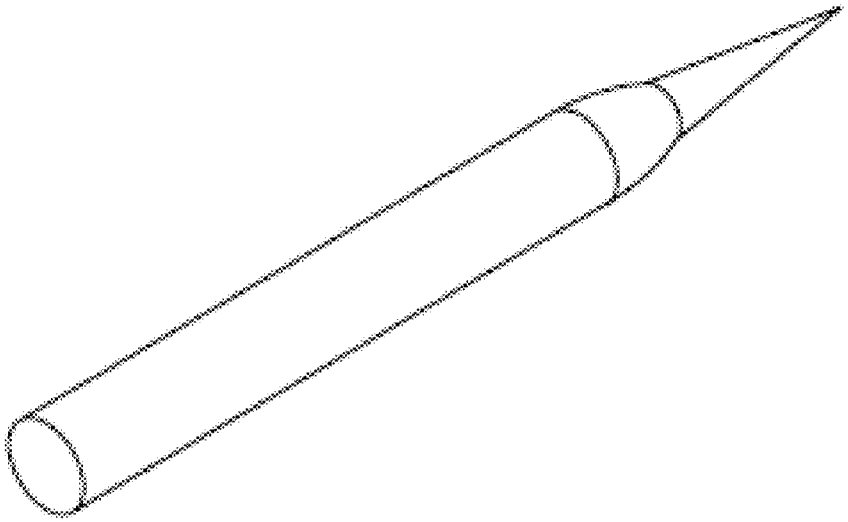
FIGS. 11A and 11B illustrate another biphasic shape that is hemispherical (e.g., convex), with FIG. 11A a perspective view to illustrate outer surface shape and FIG. 11B a cross-section illustrating a hollow shaft region.
Figure 11B:
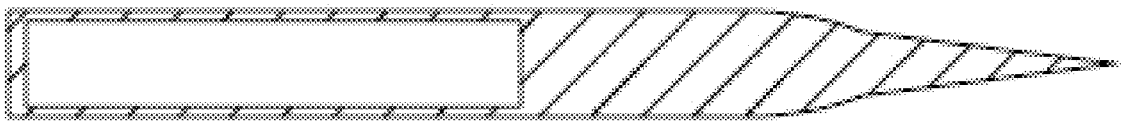

FIG. 10A-12C illustrates various tip geometries and use of reinforced elements into the shaft region for additional control of CP, CG or CM. Exemplary tip shapes include generally biphasic shapes, including rearward regions of the tip may be ogive, conical, caternary or hemispherical and have a wider apex angle than the front region of the tip. For example, FIGS. 10A-10B illustrate concave shape, and FIGS. 11A-11B hemispherical shape. Referring to FIG. 10A, the tip shape is generally described as biphasic, having two or more profile regions (1010 1020) and one or more transitional junctions (1030) located between adjacent profile regions, wherein the profile regions are symmetric about the projectile longitudinal axis (1040).

Figure 12A:
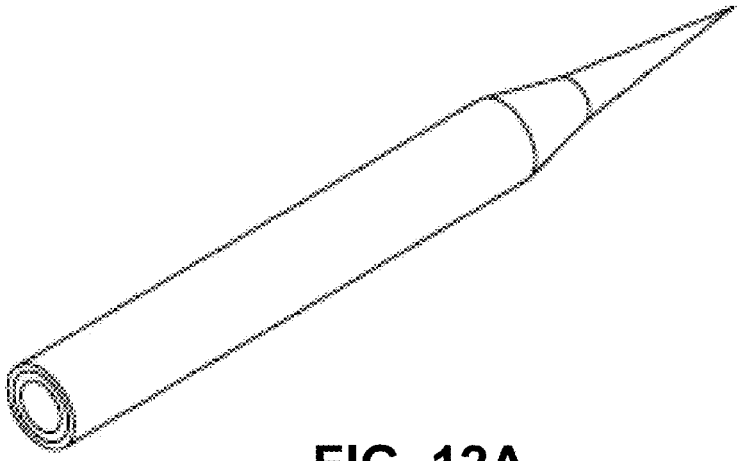
FIG. 12A-12C illustrates a carbon fiber reinforced polymer (solid bar or tube) projectile.
Figure 12B:
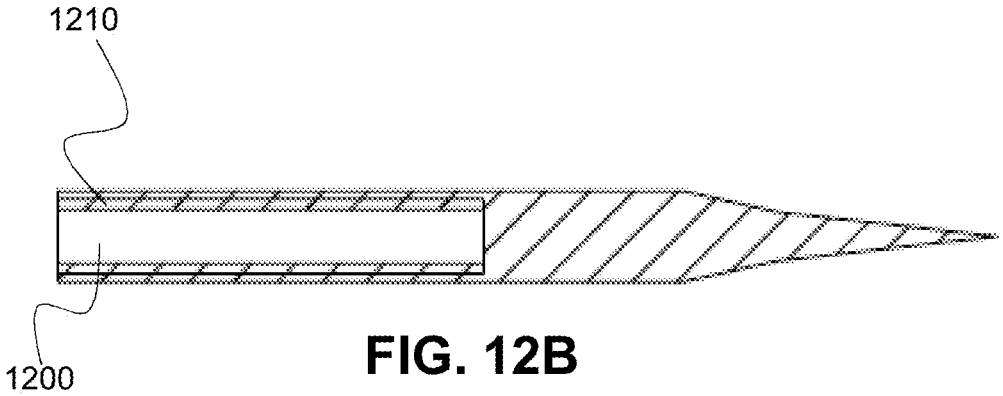
Figure 12C:
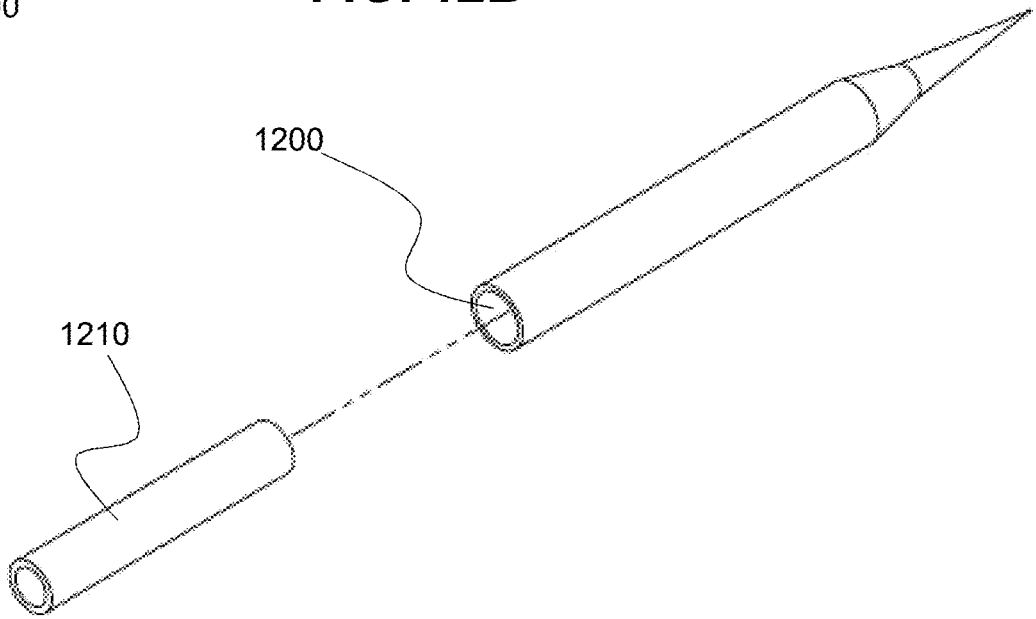

Referring to FIGS. 12A-12C, the shaft comprises a hollow region 1200 having a circular cross-section, the penetrator projectile further comprising a reinforced element 1210 that is positioned within the hollow region and is formed of a low density, high strength material that is different than the material(s) that form the shaft, neck, and tip. The reinforced element 1210 may be, as one example, a carbon fiber reinforced polymer tube (as shown) or a solid rod that occupies the entire hollow region 1200 (not illustrated).

STATEMENTS REGARDING INCORPORATION BY REFERENCE AND VARIATIONS

All references throughout this application, for example patent documents including issued or granted patents or equivalents; patent application publications; and non-patent literature documents or other source material are hereby incorporated by reference herein in their entireties, as though individually incorporated by reference, to the extent each reference is at least partially not inconsistent with the disclosure in this application (for example, a reference that is partially inconsistent is incorporated by reference except for the partially inconsistent portion of the reference).

The terms and expressions which have been employed herein are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments, exemplary embodiments and optional features, modification and variation of the concepts herein disclosed may be resorted to by those skilled in the art, and that such modifications and variations are considered to be within the scope of this invention. The specific embodiments provided herein are examples of useful embodiments of the present invention and it will be apparent to one skilled in the art that the present invention may be carried out using a large number of variations of the devices, device components, methods and steps set forth in the present description. As will be obvious to one of skill in the art, methods and devices useful for the present embodiments can include a large number of optional device components, compositions, materials, combinations and processing elements and steps.

Every device, system, combination of components or method described or exemplified herein can be used to practice the invention, unless otherwise stated.

When a group of substituents is disclosed herein, it is understood that all individual members of that group and all subgroups, including any device components, combinations, materials and/or compositions of the group members, are disclosed separately. When a Markush group or other grouping is used herein, all individual members of the group and all combinations and subcombinations possible of the group are intended to be individually included in the disclosure.

Whenever a range is given in the specification, for example, a number range, a flow-rate range, a size range, a pressure range, a velocity range, a time range, or a composition or concentration range, all intermediate ranges and subranges, as well as all individual values included in the ranges given are intended to be included in the disclosure. It will be understood that any subranges or individual values in a range or subrange that are included in the description herein can be excluded from the claims herein.

All patents and publications mentioned in the specification are indicative of the levels of skill of those skilled in the art to which the invention pertains. References cited herein are incorporated by reference herein in their entirety to indicate the state of the art as of their publication or filing date and it is intended that this information can be employed herein, if needed, to exclude specific embodiments that are in the prior art.

As used herein, "comprising" is synonymous with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. In each instance herein any of the terms "comprising", "consisting essentially of" and "consisting of" may be replaced with either of the other two terms. The invention illustratively described herein suitably may be practiced in the absence of any element or elements and/or limitation or limitations, which are not specifically disclosed herein.

One of ordinary skill in the art will appreciate that compositions, materials, components, methods and/or processing steps other than those specifically exemplified can be employed in the practice of the invention without resort to undue experimentation. All art-known functional equivalents, of any such compositions, materials, components, methods and/or processing steps are intended to be included in this invention. The terms and expressions which have been employed are used as terms of description and not of limitation, and there is no intention in the use of such terms and expressions of excluding any equivalents of the features shown and described or portions thereof, but it is recognized that various modifications are within the scope of the invention claimed. Thus, it should be understood that although the present invention has been specifically disclosed by exemplary embodiments and optional features, modification and variation of the concepts herein disclosed may be resorted to by those skilled in the art, and that such modifications and variations are considered to be within the scope of this invention as defined by the appended claims.

It must be noted that as used herein and in the appended claims, the singular forms "a", "an", and "the" include plural reference unless the context clearly dictates otherwise. Thus, for example, reference to "a layer" includes a plurality of layers and equivalents thereof known to those skilled in the art, and so forth. As well, the terms "a" (or "an"), "one or more" and "at least one" can be used interchangeably herein. It is also to be noted that the terms "comprising", "including", and "having" can be used interchangeably. The expression "of any of claims XX-YY" (wherein XX and YY refer to claim numbers) is intended to provide a multiple dependent claim in the alternative form, and in some embodiments is interchangeable with the expression "as in any one of claims XX-YY."

Unless defined otherwise, all technical and scientific terms used herein have the same meanings as commonly understood by one of ordinary skill in the art to which this invention belongs. Although any methods and materials similar or equivalent to those described herein can be used in the practice or testing of the present invention, the preferred methods and materials are described.

I claim:

1. A penetrator projectile for use in a disrupter comprising:

a tip having a tip distal end and a tip proximal end;

a neck having a neck distal end and a neck proximal end and an outer surface that is a right-angle cylinder shape equal in diameter to a bore of the disrupter, wherein the neck distal end is connected to the tip proximal end;

a shaft having a shaft distal end and a shaft proximal end, wherein the shaft distal end is connected to the neck proximal end;

a base a having a base distal end and a base proximal end, wherein the base distal end is connected to the shaft proximal end;

wherein:

each of the shaft and base have a maximum diameter that is equal to or less than a bore inner diameter of the disrupter;

the tip distal end has a pointed tip shape configured to penetrate a hard target without substantial deformation and a tip angle that is less than or equal to 30°;

the base is cylindrically-shaped with the base proximal end configured to face a breech region of the disrupter and the tip distal end faces away from the breech region and is directed on target; and the tip, neck shaft and base are together configured to provide a center of gravity (CG) and center of pressure (CP) that are separated from each other with the CG in a distal position relative to the CP.

2. The penetrator projectile of claim 1, wherein the tip shape is radially symmetric about a longitudinal axis.

3. The penetrator projectile of claim 1, wherein the tip shape is biphasic, having two or more profile regions and one or more transitional junctions located between adjacent profile regions, wherein the profile regions are symmetric about the projectile longitudinal axis.

4. The penetrator projectile of claim 1, wherein a maximum diameter of the tip ($D_{tip}$) is less than a maximum diameter of the neck ($D_{neck}$), wherein $0.001D_{bore}<(D_{tip}-D_{neck})/D_{neck}<0.05D_{bore}$, wherein $D_{bore}$ is the bore diameter of the propellant driven disrupter.

5. The penetrator projectile of claim 1, wherein the tip has a plurality of longitudinally-extending angled regions, and adjacent angled regions are separated by a knife edge.

6. The penetrator projectile of claim 1, wherein the tip has a proximal region that is ogive, conical, catenary, parabolic, convex, concave, or hemispherical with a wider angle than the tip angle.

7. The penetrator projectile of claim 1, wherein the tip has a distal region with a cross-sectional shape that is square, hexagonal, or circular.

8. The penetrator of claim 1, wherein the tip has a maximum diameter region that is up to 150% of the bore inner diameter.

9. The penetrator projectile of claim 1, wherein the neck has an outer surface that is cylindrical.

10. The penetrator projectile of claim 1, wherein the shaft comprises an inner hollow volume positioned toward a distal end of the shaft and configured to receive a solid rod, weighted tungsten or weighted shot, wherein the weighted shot has an average diameter between 30 μm and 700 μm, and the weighted shot optionally comprises lead or tungsten.

11. The penetrator projectile of claim 1, wherein the shaft is comprised of a plurality of longitudinally-extending ribs radially distributed around a symmetrical solid core.

12. The penetrator projectile of claim 1, further comprising retractable fins positioned in the shaft when the penetrator projectile is in a disrupter barrel and deploy when the penetrator projectile is fired out of the disrupter barrel.

13. The penetrator projectile of claim 1, wherein the shaft is a right angle hollow cylinder with a wall thickness, wherein the wall thickness is optionally up to eleven times smaller than a shaft outer diameter ($S_{OD}$), such as up to $0.08*S_{OD}$.

14. The penetrator of projectile of claim 1, wherein the shaft geometry is a tapered angle hollow cylinder with a wall thickness, wherein the tapered angle provides a maximum shaft diameter toward a distal shaft end and a minimum shaft diameter toward a proximal shaft end, wherein the taper angle optionally starts at a starting shaft position, including a starting shaft position that is 50% or more of the shaft length from the neck proximal end;

wherein a maximum taper region diameter is equal to or up to 20% less than a bore inner diameter, and a minimum taper region diameter at the proximal end of the shaft that is up to 50% less than a bore inner diameter.

15. The penetrator of projectile of claim 1, wherein the shaft comprises a material that is the same as the material that forms the tip and neck.

16. The penetrator projectile of claim 1, wherein the shaft comprises a hollow region having a circular cross-section, the penetrator projectile further comprising a reinforced element that is positioned within the hollow region and is formed of a low density, high strength material that is different than the material(s) that form the shaft, neck, and tip.

17. The penetrator of projectile of claim 1, wherein the shaft comprises a material that is different than a material that forms the tip and neck.

18. The penetrator of claim 1, wherein the shaft is connected to the neck via a threaded coupling, a press fit, a weld, or a silver solder.

19. The penetrator projectile of claim 1, wherein the base has a diameter that is greater than or equal to 50% of the bore inner diameter.

20. The penetrator projectile of claim 11, wherein the shaft longitudinally-extending ribs are configured to move a center of pressure of the penetrator projectile toward the base during firing and move the center of gravity toward the tip during firing.

21. The penetrator projectile of claim 1, wherein the base, shaft, neck and tip geometry are configured to provide, when fired from a disrupter, the CP positioned toward the base and behind a CG by a distance that is greater than 6% of the projectile length to provide a stable free-flight after firing.

22. The penetrator projectile of claim 1, wherein the CG is positioned 10%-30% closer to the tip distal end compared to the CP position.

23. A disrupter for improvised explosive device disruption or ordnance disruption comprising:

the penetrator projectile of claim 1, and a disrupter barrel, wherein at least a portion of the penetrator projectile is configured to be positioned within the barrel before firing.

24. A method of disrupting a target, the method comprising the steps of:

providing the penetrator projectile of claim 1;

at least partially filling a bore of a disrupter barrel with a liquid;

inserting at least a portion of the penetrator projectile into the bore of the disrupter barrel; and firing the penetrator projectile from the disrupter barrel toward the target.

25. The penetrator projectile of claim 1, further comprising:

a soft material in or over the shaft;

the disrupter barrel having a rifled bore;

wherein during use the soft material prevents damage to the rifled bore.

* * * * *